US009085396B2

(12) United States Patent
McCoy et al.

(10) Patent No.: US 9,085,396 B2
(45) Date of Patent: Jul. 21, 2015

(54) PHARMACY BOTTLE, SYSTEM, AND METHOD

(71) Applicant: TARGET BRANDS, INC., Minneapolis, MN (US)

(72) Inventors: Ryan P. McCoy, Falcon Heights, MN (US); Stacy Abel, Maple Grove, MN (US); Matthew P. Franks, Austin, MN (US); Adam D. Hoppus, Minneapolis, MN (US); Duane Sawyer, York, PA (US); Gordon Beecroft, Leola, PA (US); John Vassallo, Lititz, PA (US); Michael Makhlouf, Lititz, PA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/524,910

(22) Filed: Oct. 27, 2014

(65) Prior Publication Data

US 2015/0041425 A1 Feb. 12, 2015

Related U.S. Application Data

(63) Continuation of application No. 13/281,338, filed on Oct. 25, 2011, now Pat. No. 8,870,004.

(51) Int. Cl.
*B65D 53/02* (2006.01)
*B65D 45/00* (2006.01)
(Continued)

(52) U.S. Cl.
CPC ..... *B65D 50/048* (2013.01); *A61J 1/03* (2013.01); *A61J 1/05* (2013.01); *B65B 7/2835* (2013.01);
(Continued)

(58) Field of Classification Search
CPC ..... B65D 50/046; B65D 2215/02; B65D 2501/0081; B65D 2251/00; B65D 2543/00092; B65D 2543/00537; B65D 2543/00925; B65D 50/065; B65D 55/02; G09F 2003/0273; A61J 1/03; A61J 1/1412; A61J 2007/0436
USPC ..... 215/216, 220, 40; 206/540, 807; 40/310, 311; 220/319, 648, 649
See application file for complete search history.

(56) References Cited

U.S. PATENT DOCUMENTS

D11,149 S 4/1879 Hood
D18,997 S 4/1889 Underhill
(Continued)

FOREIGN PATENT DOCUMENTS

DE 3723671 8/1988
EP 0146095 B1 6/1985
(Continued)

OTHER PUBLICATIONS

Photographs of Advil® Bottle and CR Cap, available at least one year prior to Oct. 25, 2011 (1 page).
(Continued)

*Primary Examiner* — Stephen F Gerrity
*Assistant Examiner* — Eyamindae Jallow
(74) *Attorney, Agent, or Firm* — JoAnn M. Seaton; Griffiths & Seaton PLLC

(57) ABSTRACT

A container includes a bottle, a closure, and a ring. The bottle includes a body, a neck extending away from the body and defining an opening, and a pair of opposed ledges. Threads extend around the neck. The ledges extend radially outwardly from the neck spaced from the body and the threads. Each ledge defines a surface facing away from the body and includes an extension extending from the surface. The closure is secured over around the neck. The closure is positioned on an opposite side of the surface of each ledge as compared to the body and includes internal ramps interfacing with the extensions to maintain the closure in place. The ring is positioned between the body and the ledges. The ring is entirely maintained below the surfaces of the ledges, and each ledge interacts with the ring to maintain the ring in place relative to the bottle.

20 Claims, 40 Drawing Sheets

(51) Int. Cl.

| | |
|---|---|
| ***B65D 50/04*** | (2006.01) |
| ***B65D 1/02*** | (2006.01) |
| ***B65D 25/56*** | (2006.01) |
| ***A61J 1/03*** | (2006.01) |
| ***A61J 1/05*** | (2006.01) |
| ***B65B 7/28*** | (2006.01) |
| ***B65D 25/20*** | (2006.01) |
| *A61J 1/18* | (2006.01) |

(52) U.S. Cl.

CPC ..... *B65D 1/02* (2013.01); *B65D 25/205* (2013.01); *B65D 25/56* (2013.01); *B65D 50/04* (2013.01); *A61J 1/18* (2013.01); *B65D 2501/0081* (2013.01); *Y10S 206/807* (2013.01)

(56) References Cited

U.S. PATENT DOCUMENTS

| | | | | |
|---|---|---|---|---|
| 406,017 | A | | 6/1889 | Woodward et al. |
| 493,851 | A | | 3/1893 | Adsit |
| 605,213 | A | | 6/1898 | Weller |
| 624,701 | A | | 5/1899 | Stevenson |
| 716,793 | A | | 12/1902 | Vogeler |
| D45,565 | S | | 4/1914 | Lloyd |
| 1,181,098 | A | | 4/1916 | Lambert |
| 1,289,218 | A | | 12/1918 | Maiden |
| 1,411,510 | A | | 4/1922 | Peterson |
| 1,499,612 | A | | 7/1924 | Hammer |
| 1,554,191 | A | | 9/1925 | Alexander |
| 1,653,608 | A | | 12/1927 | Allen |
| 1,686,354 | A | | 10/1928 | Wallace |
| 1,769,147 | A | | 7/1930 | Lennon |
| 1,815,268 | A | | 7/1931 | Newbery |
| 1,850,369 | A | | 3/1932 | Andrews |
| 1,991,871 | A | | 2/1935 | Sindler |
| 1,993,978 | A | | 3/1935 | Plochman |
| 2,007,685 | A | | 7/1935 | Lyle |
| 2,110,768 | A | | 3/1938 | Kellogg |
| D128,282 | S | | 3/1941 | Gelinas et al. |
| 2,270,277 | A | | 1/1942 | Dowd |
| D132,185 | S | | 4/1942 | McIntosh |
| 2,328,806 | A | | 9/1943 | Hoofer |
| 2,528,259 | A | | 10/1950 | Annuziata |
| 2,659,614 | A | | 11/1953 | Cook et al. |
| 2,794,545 | A | | 6/1957 | Olson |
| 2,844,893 | A | | 7/1958 | Keller |
| 2,847,971 | A | | 8/1958 | Painter |
| 2,908,985 | A | | 10/1959 | Hartman |
| 2,920,777 | A | | 1/1960 | Cole |
| 2,961,108 | A | | 11/1960 | Johnson |
| 2,995,265 | A | | 8/1961 | Soderberg |
| 3,256,978 | A | | 6/1966 | Srigley et al. |
| 3,298,671 | A | | 1/1967 | Popma et al. |
| 3,331,521 | A | | 7/1967 | Paige |
| 3,423,861 | A | | 1/1969 | Forsyth |
| 3,433,378 | A | | 3/1969 | Ross |
| 3,437,194 | A | | 4/1969 | Ames et al. |
| 3,464,576 | A | | 9/1969 | Rohde |
| 3,625,547 | A | | 12/1971 | Burke |
| 3,628,266 | A | | 12/1971 | Wise |
| 3,757,994 | A | | 9/1973 | Skoetsch |
| D230,137 | S | | 1/1974 | Bettonica |
| 3,787,993 | A | | 1/1974 | Lyon |
| 3,822,780 | A | | 7/1974 | Ulmer et al. |
| 3,826,222 | A | | 7/1974 | Romick |
| 3,850,326 | A | | 11/1974 | Ryles |
| 3,901,400 | A | | 8/1975 | Westfall |
| 3,923,180 | A | | 12/1975 | Fields |
| 3,996,879 | A | | 12/1976 | Walton |
| 4,022,352 | A | | 5/1977 | Pehr |
| 4,044,889 | A | | 8/1977 | Orentreich et al. |
| 4,064,645 | A | | 12/1977 | Wood |
| 4,099,639 | A | | 7/1978 | Boxer et al. |
| RE29,793 | E | | 10/1978 | Pehr |
| 4,143,786 | A | | 3/1979 | Goldberg et al. |
| 4,150,760 | A | | 4/1979 | d'Orgelys |
| 4,154,355 | A | * | 5/1979 | Shackelford ..... 220/4.21 |
| D255,054 | S | | 5/1980 | Kingsford |
| 4,203,240 | A | | 5/1980 | Goodwin |
| 4,238,033 | A | | 12/1980 | Artzt |
| 4,246,709 | A | | 1/1981 | Selleslags |
| 4,263,734 | A | | 4/1981 | Bradshaw |
| 4,284,200 | A | | 8/1981 | Bush et al. |
| 4,285,489 | A | | 8/1981 | Blanchard |
| 4,334,638 | A | | 6/1982 | Stock |
| D270,998 | S | | 10/1983 | Stark |
| 4,428,384 | A | | 1/1984 | Raitto |
| D274,309 | S | | 6/1984 | Aldrich, III |
| 4,482,068 | A | | 11/1984 | Agbay et al. |
| 4,535,903 | A | | 8/1985 | Franchi |
| D280,601 | S | | 9/1985 | Biesecker |
| 4,567,991 | A | * | 2/1986 | Anderson ..... 215/216 |
| D282,909 | S | | 3/1986 | Biesecker |
| D285,535 | S | | 9/1986 | Buchholz et al. |
| 4,640,031 | A | | 2/1987 | Hoek et al. |
| 4,732,411 | A | | 3/1988 | Siegel |
| D295,024 | S | | 4/1988 | Trick |
| D295,954 | S | | 5/1988 | Kirchhoff |
| 4,753,358 | A | | 6/1988 | Virca et al. |
| 4,799,712 | A | | 1/1989 | Biava et al. |
| 4,802,438 | A | | 2/1989 | DeJonge |
| D300,119 | S | | 3/1989 | Pacquin |
| 4,813,570 | A | | 3/1989 | Pontoppidan |
| 4,819,351 | A | | 4/1989 | Boitani |
| 4,827,643 | A | | 5/1989 | Hearst et al. |
| 4,860,899 | A | | 8/1989 | McKee |
| 4,863,026 | A | | 9/1989 | Perkowski |
| 4,868,027 | A | | 9/1989 | Hunkeler et al. |
| 4,881,648 | A | | 11/1989 | Hagerty |
| 4,883,180 | A | | 11/1989 | Humphrey et al. |
| D305,505 | S | | 1/1990 | Kunesh |
| 4,890,742 | A | | 1/1990 | Allison |
| 4,913,083 | A | | 4/1990 | Valvo et al. |
| 4,918,604 | A | | 4/1990 | Baum |
| 4,919,285 | A | | 4/1990 | Roof et al. |
| 4,941,573 | A | | 7/1990 | Fuerstman |
| 4,972,657 | A | | 11/1990 | McKee |
| D312,776 | S | | 12/1990 | Taconelli |
| 4,991,877 | A | | 2/1991 | Lieberman |
| 5,011,032 | A | | 4/1991 | Rollman |
| 5,020,682 | A | | 6/1991 | Dutt |
| D319,181 | S | | 8/1991 | Balavich |
| 5,048,870 | A | | 9/1991 | Mangni et al. |
| D323,780 | S | | 2/1992 | Addante |
| D324,994 | S | | 3/1992 | Jentgen |
| 5,102,169 | A | | 4/1992 | Mayfield |
| D328,246 | S | | 7/1992 | Nottingham et al. |
| 5,145,080 | A | | 9/1992 | Imbery, Jr. |
| 5,165,546 | A | | 11/1992 | Jaeger et al. |
| 5,172,936 | A | | 12/1992 | Sullivan et al. |
| 5,178,311 | A | | 1/1993 | McBride |
| D333,618 | S | | 3/1993 | Patel et al. |
| 5,193,032 | A | | 3/1993 | Hirth |
| 5,204,775 | A | | 4/1993 | McDevitt |
| 5,213,225 | A | | 5/1993 | King et al. |
| 5,215,334 | A | | 6/1993 | Presson et al. |
| 5,261,702 | A | | 11/1993 | Mayfield |
| D342,452 | S | | 12/1993 | Monaghan |
| D343,360 | S | | 1/1994 | Poo |
| 5,284,363 | A | | 2/1994 | Gartner et al. |
| 5,301,802 | A | | 4/1994 | Nemeroff |
| 5,301,840 | A | | 4/1994 | Sun |
| 5,309,279 | A | | 5/1994 | Halstead |
| 5,342,093 | A | | 8/1994 | Weernink |
| D350,691 | S | | 9/1994 | Simion |
| 5,343,647 | A | | 9/1994 | Bulka |
| 5,346,069 | A | | 9/1994 | Intini |
| D351,796 | S | | 10/1994 | Deddens |
| 5,351,991 | A | | 10/1994 | McDonald |
| 5,379,927 | A | | 1/1995 | Montenieri et al. |
| D355,125 | S | | 2/1995 | Patel et al. |
| D355,126 | S | | 2/1995 | Paulovich et al. |
| D355,363 | S | | 2/1995 | Iorii et al. |
| 5,386,795 | A | | 2/1995 | Bartholomew |

(56) References Cited

U.S. PATENT DOCUMENTS

| | | | |
|---|---|---|---|
| 5,403,636 | A | 4/1995 | Crum |
| D360,134 | S | 7/1995 | Snyder |
| 5,448,844 | A | 9/1995 | Miller, Jr. et al. |
| 5,476,420 | A | 12/1995 | Manning |
| 5,495,944 | A | 3/1996 | Lermer |
| D370,636 | S | 6/1996 | Crawford |
| 5,555,655 | A | 9/1996 | Yager et al. |
| 5,588,239 | A | 12/1996 | Anderson |
| 5,601,314 | A | 2/1997 | Burns et al. |
| 5,632,420 | A | 5/1997 | Lohrman et al. |
| 5,642,906 | A | 7/1997 | Foote et al. |
| 5,660,138 | A | 8/1997 | Hirsch |
| 5,662,224 | A | 9/1997 | Nogues |
| 5,662,239 | A | 9/1997 | Heuvelman |
| 5,687,863 | A | 11/1997 | Kusz |
| 5,697,173 | A | 12/1997 | McCarrick et al. |
| 5,699,922 | A | 12/1997 | Harding |
| D389,064 | S | 1/1998 | Sethi et al. |
| 5,704,144 | A | 1/1998 | Groth |
| 5,704,648 | A | 1/1998 | Brown et al. |
| 5,711,442 | A | 1/1998 | Kusz |
| 5,713,681 | A | 2/1998 | Venne et al. |
| 5,718,347 | A | 2/1998 | Walker et al. |
| 5,719,828 | A | 2/1998 | Haas et al. |
| 5,729,922 | A | 3/1998 | Peterson et al. |
| 5,730,292 | A | 3/1998 | Jones |
| 5,758,440 | A | 6/1998 | Yudin |
| 5,760,975 | A | 6/1998 | DiGiovanni |
| D395,828 | S | 7/1998 | Lecoule |
| 5,779,072 | A | 7/1998 | Krebs |
| 5,788,974 | A | 8/1998 | D'Amico et al. |
| 5,799,815 | A | 9/1998 | Lang |
| 5,800,144 | A | 9/1998 | Glenn et al. |
| 5,819,967 | A | 10/1998 | Lo |
| 5,829,789 | A | 11/1998 | Treleaven et al. |
| 5,836,465 | A | 11/1998 | King |
| 5,887,736 | A | 3/1999 | Mar |
| 5,918,758 | A | 7/1999 | Galton-Fenzi |
| D413,067 | S | 8/1999 | Haley |
| 5,980,352 | A | 11/1999 | Rigberg |
| 6,003,902 | A | 12/1999 | Petkovsek |
| D419,077 | S | 1/2000 | Sultan |
| 6,016,930 | A | 1/2000 | Mathes et al. |
| 6,023,865 | A | 2/2000 | Preuss |
| D423,361 | S | 4/2000 | Negre |
| D425,427 | S | 5/2000 | Heeter |
| 6,068,300 | A | 5/2000 | Vijuk et al. |
| D427,073 | S | 6/2000 | Gaffney et al. |
| 6,081,392 | A | 6/2000 | Pensmith |
| 6,086,702 | A | 7/2000 | Rea |
| 6,089,180 | A | 7/2000 | Nichols, Jr. |
| 6,105,801 | A | 8/2000 | Minnette |
| D430,802 | S | 9/2000 | Adachi et al. |
| 6,127,013 | A | 10/2000 | Todd |
| 6,158,779 | A | 12/2000 | Petrick |
| 6,196,593 | B1 | 3/2001 | Petrick et al. |
| 6,209,921 | B1 | 4/2001 | Hogan et al. |
| 6,220,439 | B1 | 4/2001 | Virvo |
| 6,226,564 | B1 | 5/2001 | Stuart |
| 6,241,844 | B1 | 6/2001 | Petkovsek |
| D445,338 | S | 7/2001 | Helleu |
| 6,253,958 | B1 | 7/2001 | Coletti |
| 6,270,121 | B1 | 8/2001 | Dolan et al. |
| 6,276,725 | B1 | 8/2001 | Laurash et al. |
| 6,278,545 | B1 | 8/2001 | Napier |
| D447,694 | S | 9/2001 | Leggett |
| D451,809 | S | 12/2001 | Jones |
| 6,360,462 | B1 | 3/2002 | Mengel |
| D456,271 | S | 4/2002 | Maloney |
| 6,366,401 | B1 | 4/2002 | Gonda et al. |
| 6,367,639 | B1 | 4/2002 | Mar |
| 6,367,640 | B1 | 4/2002 | Julian |
| 6,379,007 | B1 | 4/2002 | Farb |
| D457,063 | S | 5/2002 | Bakic |
| 6,386,367 | B1 | 5/2002 | Bayliss, IV |
| D459,212 | S | 6/2002 | Gobe |
| 6,402,872 | B1 | 6/2002 | Key |
| 6,491,164 | B1 | 12/2002 | Virvo |
| D470,415 | S | 2/2003 | Weber |
| 6,549,345 | B1 | 4/2003 | Cardarelli |
| D474,690 | S | 5/2003 | Bakic |
| 6,568,530 | B2 | 5/2003 | Takahashi et al. |
| 6,594,928 | B1 | 7/2003 | Clawson et al. |
| D480,002 | S | 9/2003 | Canepa |
| D480,005 | S | 9/2003 | Conway |
| 6,621,629 | B2 | 9/2003 | Blumenthal et al. |
| D480,960 | S | 10/2003 | Gray et al. |
| D481,165 | S | 10/2003 | Angeletta |
| 6,669,804 | B2 | 12/2003 | Pendry et al. |
| D485,764 | S | 1/2004 | Bakic |
| 6,681,945 | B1 | 1/2004 | Harrold |
| 6,698,605 | B2 | 3/2004 | Clodfelter et al. |
| 6,712,398 | B1 | 3/2004 | Fox et al. |
| 6,722,495 | B2 | 4/2004 | Fresnel |
| 6,745,505 | B2 | 6/2004 | Moran |
| 6,752,272 | B2 | 6/2004 | Jones et al. |
| 6,789,497 | B1 | 9/2004 | Aiken |
| D497,311 | S | 10/2004 | Walsh et al. |
| 6,860,390 | B2 | 3/2005 | Bowman |
| 6,860,513 | B2 | 3/2005 | Kaufman |
| 6,868,627 | B2 | 3/2005 | Elias |
| 6,871,752 | B2 | 3/2005 | Montgomery |
| 6,923,376 | B2 | 8/2005 | Gosden et al. |
| 6,951,353 | B2 | 10/2005 | Kozlowski et al. |
| 6,964,345 | B2 | 11/2005 | Wetherell, Jr. et al. |
| D520,365 | S | 5/2006 | Andoh |
| D522,867 | S | 6/2006 | Bakic |
| 7,061,831 | B2 | 6/2006 | De La Huerga |
| D526,569 | S | 8/2006 | Wurster et al. |
| 7,128,227 | B2 | 10/2006 | Skillin et al. |
| D537,349 | S | 2/2007 | Ball et al. |
| D539,651 | S | 4/2007 | Snyder |
| D540,179 | S | 4/2007 | Adler et al. |
| D540,690 | S | 4/2007 | Adler et al. |
| D541,159 | S | 4/2007 | Robinson |
| D542,661 | S | 5/2007 | Adler et al. |
| 7,222,736 | B1 | 5/2007 | Seijas |
| 7,225,052 | B2 | 5/2007 | Foote et al. |
| 7,225,937 | B2 | 6/2007 | Schroeder |
| D550,571 | S | 9/2007 | Diaz |
| D554,999 | S | 11/2007 | Nukuto et al. |
| D555,498 | S | 11/2007 | Bansal |
| 7,311,205 | B2 | 12/2007 | Adler et al. |
| D559,117 | S | 1/2008 | Nukuto et al. |
| 7,320,483 | B2 | 1/2008 | Eippert |
| D566,330 | S | 4/2008 | Angeletta |
| D572,593 | S | 7/2008 | Adler et al. |
| D574,717 | S | 8/2008 | Adler et al. |
| 7,413,082 | B2 | 8/2008 | Adler et al. |
| D581,275 | S | 11/2008 | Adler |
| D583,242 | S | 12/2008 | Adler et al. |
| D594,336 | S | 6/2009 | Adler |
| D597,841 | S | 8/2009 | Adler et al. |
| 7,621,413 | B2 | 11/2009 | Miota et al. |
| 7,628,427 | B2 | 12/2009 | Adler et al. |
| 7,661,384 | B2 | 2/2010 | Mataya |
| 7,661,533 | B2 | 2/2010 | Adler et al. |
| 7,942,451 | B2 | 5/2011 | Adler |
| 7,980,391 | B2 | 7/2011 | Adler et al. |
| 8,025,314 | B2 | 9/2011 | Adler |
| 8,051,999 | B2 | 11/2011 | Carmody et al. |
| 8,240,491 | B2 | 8/2012 | Beecroft et al. |
| 8,534,220 | B1 | 9/2013 | Olson |
| 8,752,705 | B2 | 6/2014 | Adler et al. |
| 2001/0017817 | A1 | 8/2001 | De La Huerga |
| 2002/0020088 | A1 | 2/2002 | Kreutner |
| 2002/0041091 | A1 | 4/2002 | Eippert |
| 2002/0063739 | A1 | 5/2002 | Gosden et al. |
| 2002/0088732 | A1 | 7/2002 | Takahashi et al. |
| 2002/0126585 | A1 | 9/2002 | Osberg et al. |
| 2002/0129758 | A1 | 9/2002 | Hanley et al. |
| 2002/0162261 | A1 | 11/2002 | West et al. |
| 2002/0171238 | A1 | 11/2002 | Kozlowski et al. |
| 2003/0025320 | A1 | 2/2003 | Shoemaker |

(56) References Cited

U.S. PATENT DOCUMENTS

| | | | |
|---|---|---|---|
| 2003/0028392 | A1 | 2/2003 | Davies |
| 2003/0091687 | A1 | 5/2003 | Copelan |
| 2003/0127351 | A1 | 7/2003 | Takahashi et al. |
| 2003/0147450 | A1 | 8/2003 | Wiltonsky et al. |
| 2003/0192211 | A1 | 10/2003 | Elias |
| 2003/0193181 | A1 | 10/2003 | Hung |
| 2003/0193185 | A1 | 10/2003 | Valley et al. |
| 2003/0205897 | A1 | 11/2003 | Kaufman |
| 2003/0214129 | A1 | 11/2003 | Adler |
| 2004/0045863 | A1 | 3/2004 | Rhoades |
| 2004/0050750 | A1 | 3/2004 | Hannan et al. |
| 2004/0056479 | A1 | 3/2004 | Fox et al. |
| 2004/0075272 | A1 | 4/2004 | Kaufman |
| 2004/0169000 | A1 | 9/2004 | Ramsey |
| 2004/0193454 | A1 | 9/2004 | Foote et al. |
| 2004/0232023 | A1 | 11/2004 | Bansal et al. |
| 2004/0237311 | A1 | 12/2004 | Brown et al. |
| 2005/0029154 | A1 | 2/2005 | Kahn et al. |
| 2005/0121406 | A1 | 6/2005 | Brozell et al. |
| 2005/0150857 | A1 | 7/2005 | Brozell et al. |
| 2005/0205513 | A1 | 9/2005 | Hidding |
| 2006/0163103 | A1 | 7/2006 | Adler et al. |
| 2006/0163869 | A1 | 7/2006 | Adler et al. |
| 2006/0213860 | A1 | 9/2006 | Robinson |
| 2006/0273063 | A1 | 12/2006 | Borger |
| 2007/0029788 | A1 | 2/2007 | Adler et al. |
| 2007/0102316 | A1 | 5/2007 | Van Der Krogt et al. |
| 2008/0017602 | A1 | 1/2008 | Adler et al. |
| 2009/0026104 | A1 | 1/2009 | Cassidy |
| 2009/0050514 | A1 | 2/2009 | Devaux-Day |
| 2009/0090688 | A1 | 4/2009 | Fruchter |
| 2009/0127157 | A1 | 5/2009 | Costa et al. |
| 2009/0301985 | A1 | 12/2009 | Priebe et al. |
| 2010/0038279 | A1 | 2/2010 | Estep |
| 2010/0051572 | A1 | 3/2010 | Beecroft et al. |
| 2010/0147732 | A1 | 6/2010 | Delagrange et al. |
| 2010/0313527 | A1 | 12/2010 | Jajoo et al. |
| 2010/0314351 | A1 | 12/2010 | Hoefling |
| 2011/0155624 | A1 | 6/2011 | Caron et al. |

FOREIGN PATENT DOCUMENTS

| | | | |
|---|---|---|---|
| EP | 0316636 | A2 | 5/1989 |
| EP | 0609955 | B1 | 4/1998 |
| EP | 0609954 | B1 | 7/1998 |
| EP | 0924676 | A2 | 6/1999 |
| FR | 2296391 | A1 | 7/1976 |
| GB | 2006713 | A | 5/1979 |
| GB | 2126565 | A | 3/1984 |
| JP | 10297640 | | 11/1998 |
| WO | 00/28474 | | 5/2000 |
| WO | 00/64676 | | 11/2000 |
| WO | 01/45028 | A1 | 6/2001 |
| WO | 03098275 | A2 | 11/2003 |
| WO | 2004048216 | A1 | 6/2004 |

OTHER PUBLICATIONS

Office Action from Canadian Patent Application No. 2,769,779, mailed Sep. 29, 2012 (3 pages).

Office Action from Canadian Patent Application No. 2,809,252, mailed Jul. 8, 2013 (2 pages).

Office Action from Canadian Patent Application No. 2,76,779, mailed May 25, 2012 (2 pages).

Office Action from Canadian Patent Application No. 2,809,252, mailed Apr. 1, 2014 (2 pages).

"Multi-Dose, Multi-Color, I.V. Bag Rings," www.medidose.com/catalog/ivpharm/bagrings.html, publicly advertised online at least as early as Apr. 27, 2002 based on the internet archive available at www.archive.org (1 page).

* cited by examiner

PHARMACY BOTTLE, SYSTEM, AND METHOD

CROSS-REFERENCE TO RELATED APPLICATION

This application is a continuation of and claims priority to U.S. patent application Ser. No. 13/281,338, filed Oct. 25, 2011, which is incorporated herein by reference.

BACKGROUND OF THE INVENTION

Virtually everyone consumes prescription pharmaceuticals at one time or another. A large volume of information about the patient, pharmacy, physician, and drug is provided on the prescription sticker on the bottle, juxtaposed with numerous warning or cautionary labels haphazardly placed on the bottle. Additional information is provided on one or more printed, folded sheets, which are included with the prescription bottle. Faced with this relatively chaotic presentation of seemingly obscure facts and requests, consumers can easily misunderstand many aspects related to their prescription. This situation is compounded when a consumer takes several prescriptions and/or when several members of the household each have one or more prescriptions, causing the multiple instructions and warnings to become overwhelming. Other pharmacy bottle systems have proven difficult to use especially for elderly patients. In view of at least the above issues, pharmacy systems including prescription containers and accessories that simplify the presentation of information or otherwise make a prescription container easier to use are desirable.

SUMMARY

One embodiment of the invention relates to a container comprising a bottle, a closure, and a ring. The bottle includes a body, a neck, and a pair of opposed ledges. The body defines a storage chamber therein. The neck extends away from the body and defines an opening opposite and providing access to the body. The neck includes threads extending around an outside surface of the neck. The pair of opposed ledges each extends radially outwardly from the neck and is spaced from each of and positioned between the body and the threads. Each of the pair of opposed ledges defines a surface facing away from the body and includes a ramped extension extending from the surface further away from the body. The closure is secured over the opening and around the neck. The closure is positioned on an opposite side of the surface of each of the pair of opposed ledges as compared to the body and includes internal ramps each interfacing with one of the ramped extensions to selectively maintain the closure in place over the opening. The ring is formed separately from the bottle and positioned between the body and the pair of opposed ledges. The ring is entirely maintained below the surface of each of the pair of opposed ledges, and each of the pair of opposed ledges interacts with the ring to maintain the ring in place relative to the bottle. Other labels, bottles, associated combinations, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

In the following detailed description, reference is made to the accompanying drawings, which form a part hereof, and in which is shown by way of illustration specific embodiments in which the invention may be practiced. The following detailed description, therefore, is not to be taken in a limiting sense, and the scope of the present invention is defined by the appended claims.

Embodiments of the invention are directed to a pharmacy container system that not only enhances a consumer's experience in having a prescription filled at a retail pharmacy and but also improves efficiencies in the pharmacy allowing prescriptions to be processed more easily. In one embodiment, a pharmacy system comprises a plurality of bottles, closures, and rings. The plurality of bottles are each sized and shaped to hold a different volume of medication from a prescription, such as pills, syrup, or other forms of medication. In one embodiment, the plurality of bottles are provided in a number of sizes, but a neck of each of the plurality of bottles is sized substantially identical to necks of the other sized bottles. As such, all sizes of bottles in the plurality of bottles are configured to receive the same closures. In one embodiment, the similarly sized neck and/or other common structure of the plurality of bottles formed on or near the neck also permit use of similarly sized rings that selectively couple with, e.g., extend around, the neck of any size bottle of the plurality of bottles differentiating bottles used for prescriptions for different family or household members.

Forming the bottles with similar necks and associated components to receive the same closures, rings, etc. decreases the number of items needed in a pharmacy inventory, which is desirable as it increases the ease of stocking the pharmacy and the space needed to store the various pharmacy system components. For example, in one embodiment, the number of inventoried items in a system of four sizes of bottles with child resistant and non-child resistant closures can be reduced from twelve (e.g., four bottles sizes, four differently sized child resistant closures, and four differently sized non-child resistant closures) to six (e.g., four bottle sizes, one size child resistant closure, and one size non-child resistant closure). Where similarly sized rings can be used on all sizes of the plurality of bottles, as will be further described below, the total number of inventoried items can be further reduced, which additionally increases efficiencies with the system.

As described herein, the pharmacy container system 10 also provides a system for receiving substantially non-elastomeric rings demarking each pharmacy container with a readily identifiable associated with one of a plurality of family our household members. In one embodiment, features on each bottle for interaction with the rings also interact with child-resistant and/or non child-resistant closures.

Figure 1:
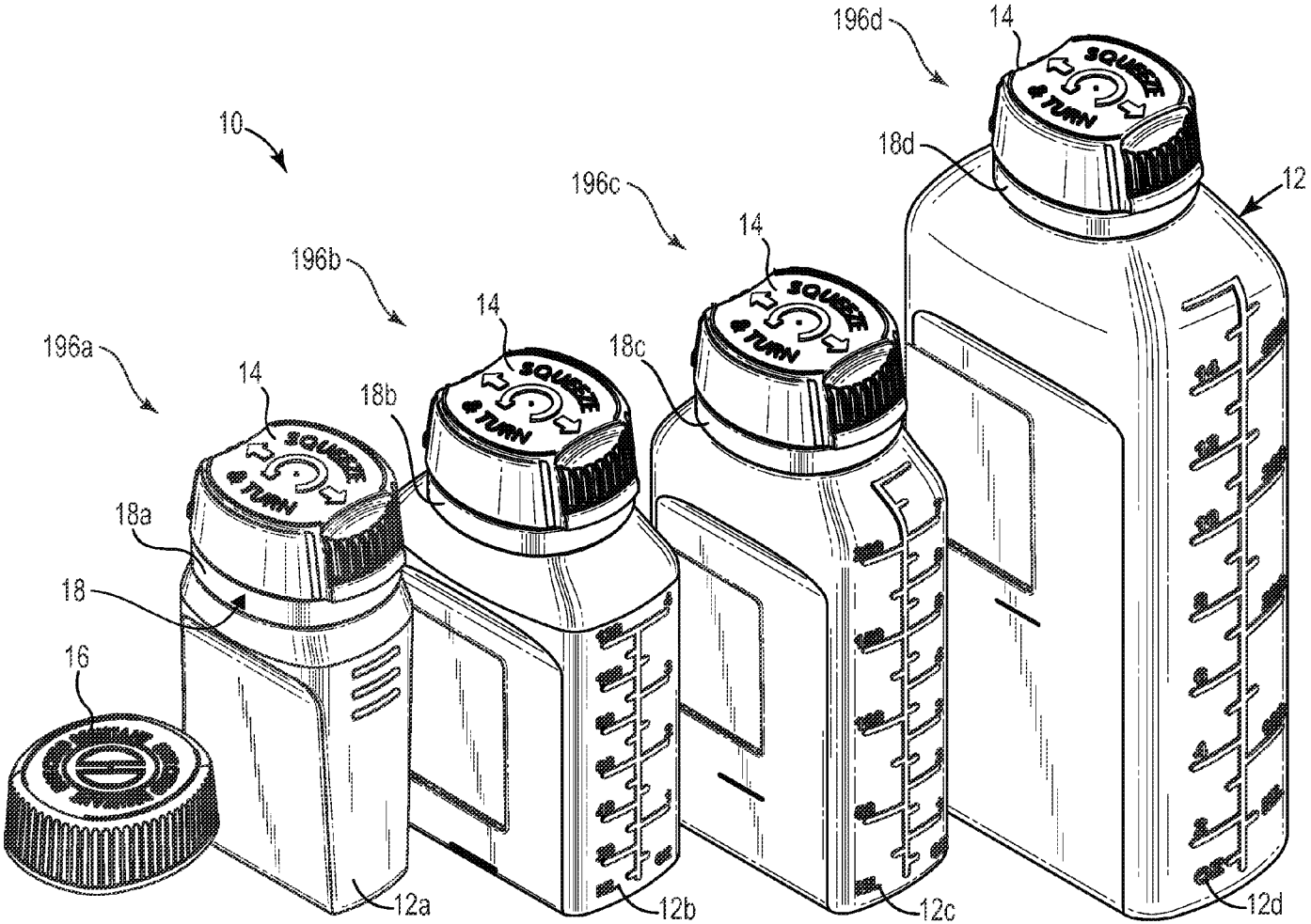
FIG. 1 is a front, top, perspective view illustration a pharmacy system including a plurality of bottles, a plurality of rings, and a plurality of closures, according to one embodiment of the invention.
Figure 2:
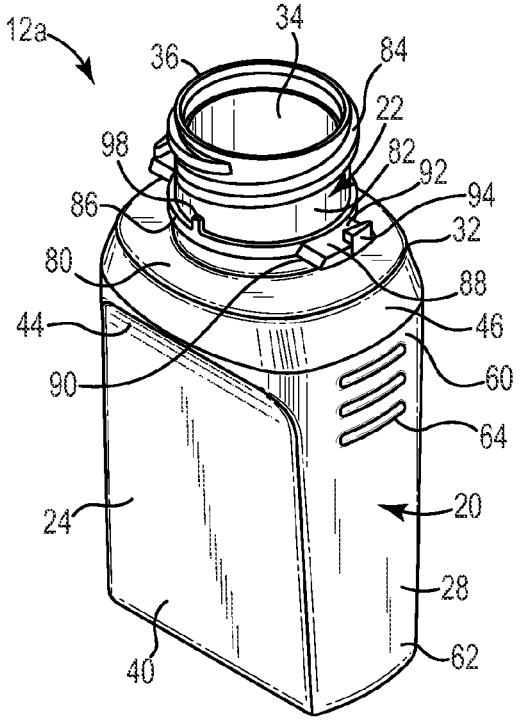
FIG. 2 is a front, top, and perspective view illustration of a first bottle of the plurality of bottles in FIG. 1, according to one embodiment of the invention.

Referring to the figures, FIG. 1 illustrates a pharmacy container system 10 including a plurality of bottles 12 (including bottles 12*a*, 12*b*, 12*c*, and 12*d*, each being a different size), a child resistant closure 14, and a non-child resistant closure 16. Both child resistant closure 14 and non-child resistant closure 16 are configured to securely fit with and be coupled to each of the plurality of bottles 12, regardless of the specific bottle size. In one embodiment, pharmacy container system 10 also includes rings 18 of various colors or other demarcations for assignment to different family or household members. Rings 18 are all the same size and are all configured to fit with and be coupled to each of the plurality of bottles 12, regardless of the specific bottle size. In one example, each bottle 12 and closure 14 or 16 assembly is considered a pharmacy container. In one example, each pharmacy container also includes one ring 18. Example pharmacy containers 196*a*, 196*b*, 196*c*, and 196*d* are illustrated in FIG. 1.

FIGS. 2-9 illustrate various views of bottle 12*a*, which is the one of the plurality of bottles 12 that is smallest in size, according to one embodiment of the present invention. Bottle 12*a* includes a body 20 and a neck 22 extending from body 20 and defining an opening 36 opposite body 20 providing access to a storage chamber 34 of bottle 12*a* for containing a medication. As such, body 20 is one example of means for containing medication in storage chamber 34.

In one embodiment, body 20 includes a front panel 24, a rear panel 26, side panels 28, and a spine or bottom panel 30. Front panel 24 is positioned opposite rear panel 26, and one of side panels 28 extends between front panel 24 and rear panel 26 on either side of bottle 12*a* to define storage chamber 34 therebetween. Bottom panel 30 extends between front panel 24, rear panel 26, and side panels 28 to enclose an end of bottle 12*a*. In one embodiment, bottle panel 12*a* is substantially planar such that bottle 12*a* can be placed with bottle panel 12*a* on a support surface (not shown) and bottle 12*a* will be supported by and extend upwardly from bottle panel 12*a*.

Neck 22 extends away from a portion of bottle 12*a* opposite bottle panel 30 to form an end of bottle 12*a* opposite bottom panel 30. In one embodiment, body 20 of bottle 12*a* defines shoulders 32 extending from front panel 24, rear panel 26, and side panels 28 to neck 22 opposite bottom panel 30. Neck 22 defines opening 36 opposite body 20, and opening 36 provides access to storage chamber 34 permitting medication to be placed in and be removed from storage chamber 34 via opening 36. In one embodiment, neck 22 is threaded, e.g., double threaded, and defines opening 36 opposite body 20 providing access through neck 22 to storage chamber 34 such that threaded neck 44 is configured to threadably receive either child resistant closure 14 or non-child resistant closure 16 to cover opening 36. As such, neck 22 with opening 36 with threads is one example of means for providing access to storage chamber 34 and for selectively receiving a closure, e.g., child-resistant closure 14 or non child-resistant closure 16. Embodiments of neck 22 are further described below.

In one embodiment, front panel 24 and rear panel 26 of body 20 each define a substantially planar outer surface 40 and 42, respectively, that is substantially rectangularly shaped, thereby defining a generally flat, broad surface especially suited for reading information on portions of a label (not shown) applied thereto (e.g., a label similar to that described in U.S. Pat. No. 7,311,205, filed Jan. 25, 2005, and issued Dec. 25, 2007, which is hereby incorporated by reference). For example, substantially planar surfaces 40 and 42 enable display of label information in a manner in which all of the information printed on a portion of a label applied to each of substantially planar surfaces 40 and 42 can be read without turning or rotating bottle 12*a*.

In one embodiment, when in a right side-up orientation (e.g., when bottle 12*a* is placed on a support surface via one of child resistant closure 14 and non-child resistant closure 16), front panel 24 and rear panel 26 of body 20 each extend at a slight angle A (see FIG. 6) relative to a vertical plane, so that when bottle 12*a* is set on a support surface (not shown) via cap 24, front panel 24 and rear panel 26 are tilted slightly upward to improve readability of the associated label. This easy-read tilting feature is enabled by the size, shape, and position of side panels 28, relative to front panel 24 and rear panel 26 of body 20.

In one example, the relatively broad nature of substantially planar surfaces 50 of front panel 24 and rear panel 26 of container 20 enable a bottle 12 to be set down on its side (i.e., not on one of child resistant closure 14 or non-child resistant closure 16 or bottom panel 30) onto a support surface without bottle 12*a* rolling along the support surface. In particular, the breadth and relative flatness of front panel 24 or rear panel 26 prevent rolling of bottle 12*a* when either one of front panel 24 or rear panel 26 are placed directly on the support surface.

Figure 3:
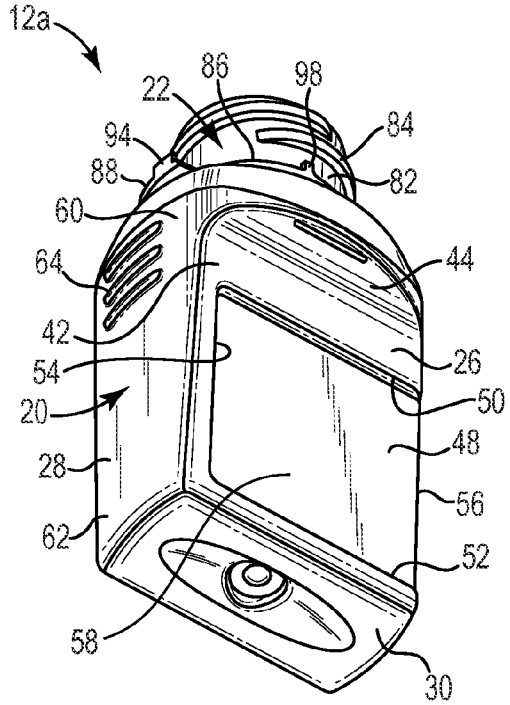
FIG. 3 is a rear, bottom, and perspective view illustration of the first bottle of FIG. 2, according to one embodiment of the invention.
Figure 4:
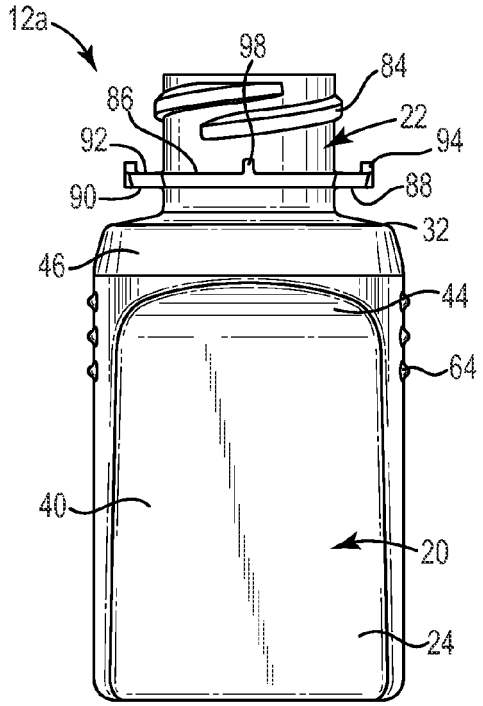
FIG. 4 is a front view illustration of the first bottle of FIG. 2, according to one embodiment of the invention.
Figure 5:
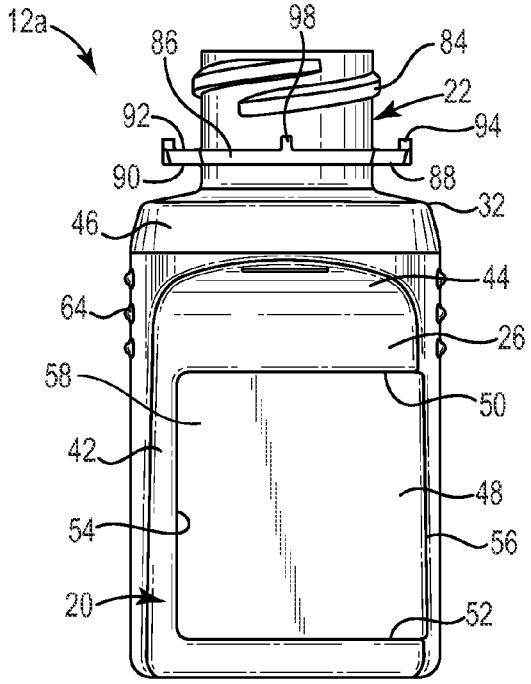
FIG. 5 is a rear view illustration of the first bottle of FIG. 2, according to one embodiment of the invention.
Figure 6:
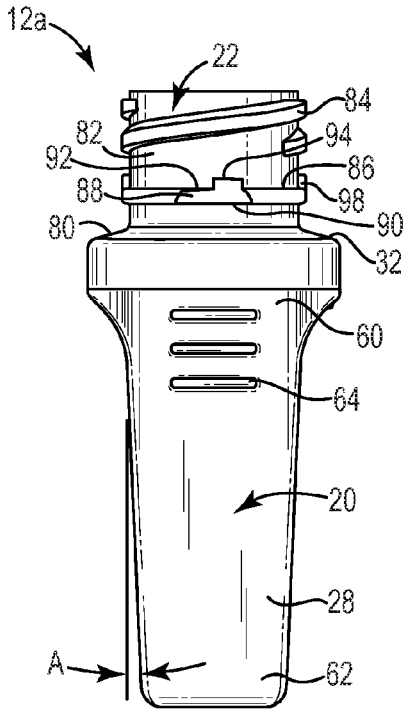
FIG. 6 is a right side view illustration of the first bottle of FIG. 2, according to one embodiment of the invention.
Figure 7:
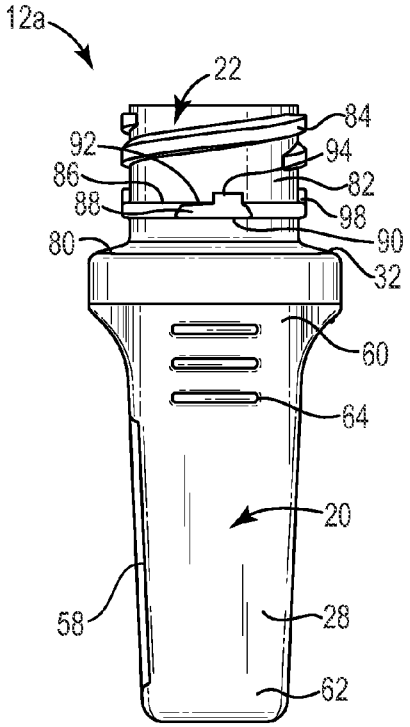
FIG. 7 is a left side view illustration of the first bottle of FIG. 2, according to one embodiment of the invention.
Figure 8:
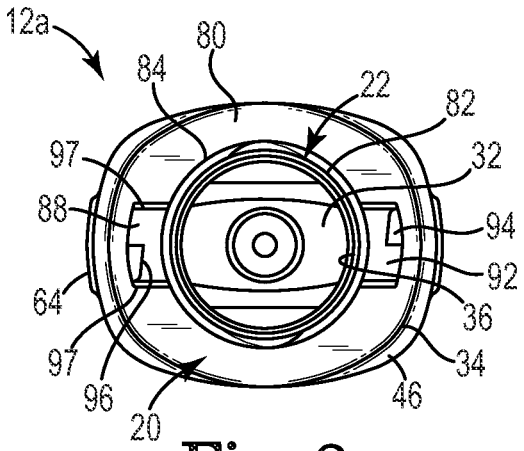
FIG. 8 is a top view illustration of the first bottle of FIG. 2, according to one embodiment of the invention.
Figure 9:
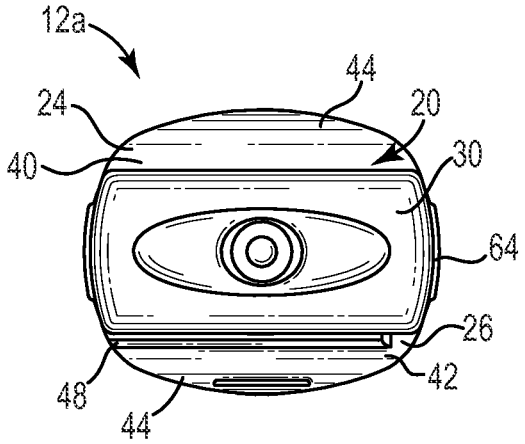
FIG. 9 is bottom view illustration of the first bottle of FIG. 2, according to one embodiment of the invention.
Figure 10:
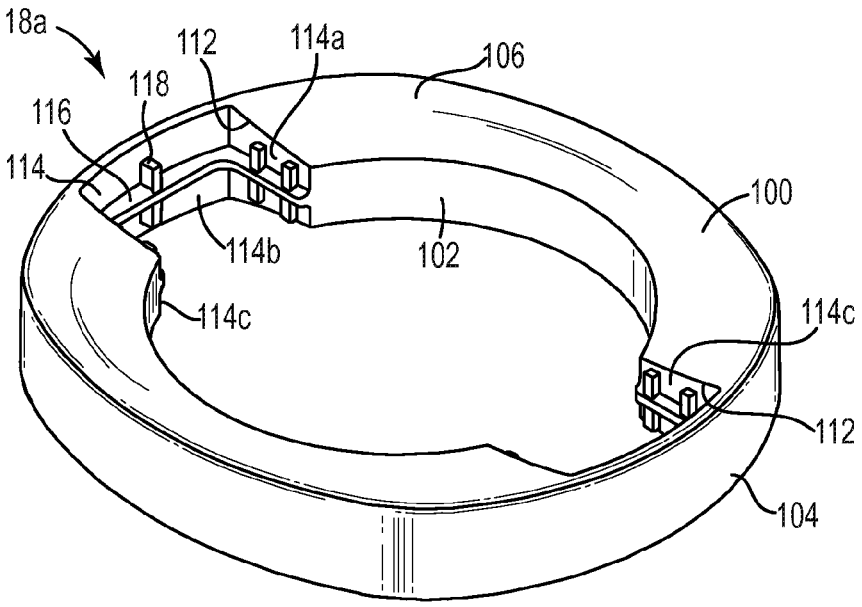
FIG. 10 is a front, top, and perspective view illustration of a ring of the plurality of rings in FIG. 1, according to one embodiment of the invention.
Figure 11:
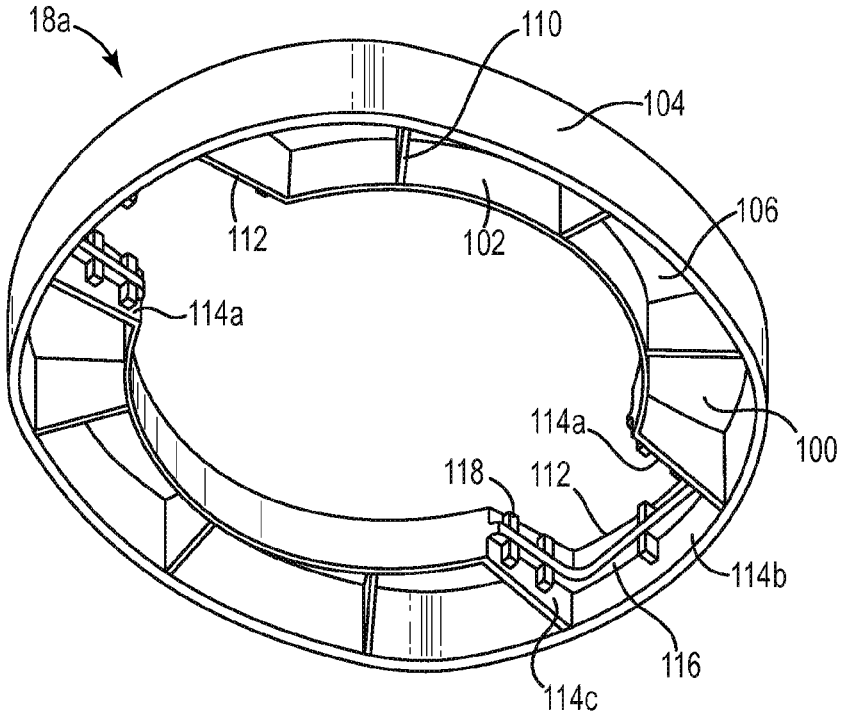
FIG. 11 is a rear, bottom, and perspective view illustration of the ring of FIG. 10, according to one embodiment of the invention.
Figure 12:
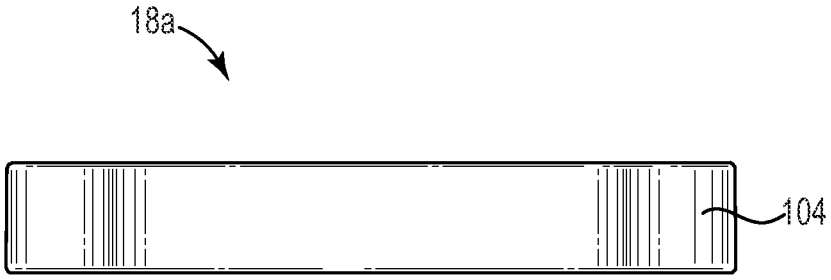
FIG. 12 is a front view illustration of the ring of FIG. 10, the rear view illustration of the ring of FIG. 10 being a mirror image of the front view illustration, according to one embodiment of the invention.
Figure 13:
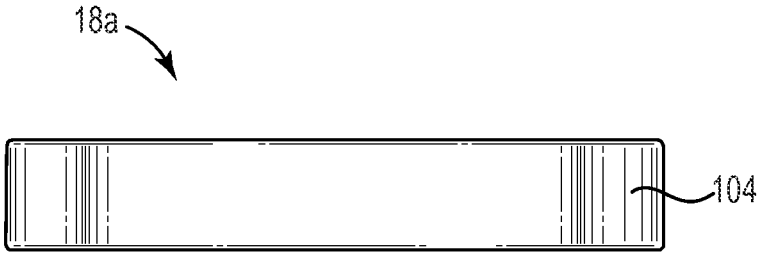
FIG. 13 is a right side view illustration of the ring of FIG. 10, the left side view illustration of the ring of FIG. 10 being a mirror image of the right side view illustration, according to one embodiment of the invention.
Figure 14:
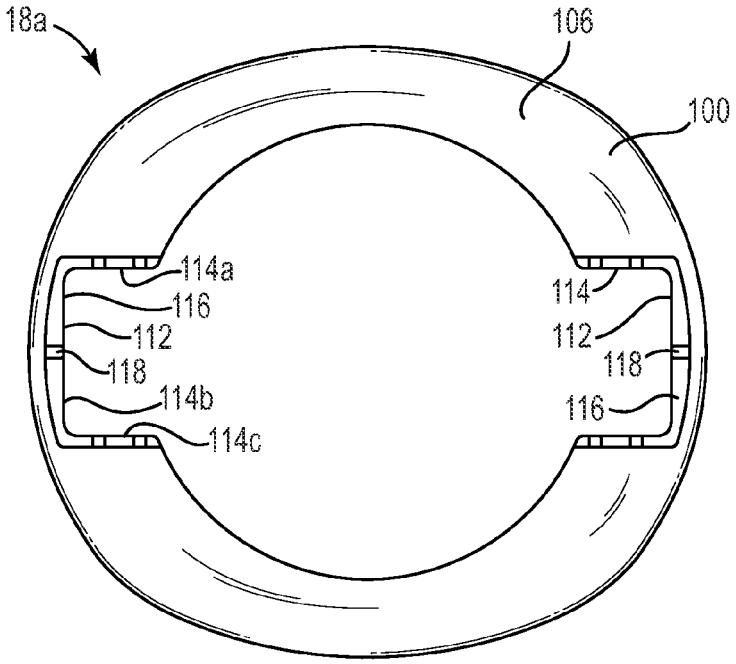
FIG. 14 is a top view illustration of the ring of FIG. 10, according to one embodiment of the invention.
Figure 15:
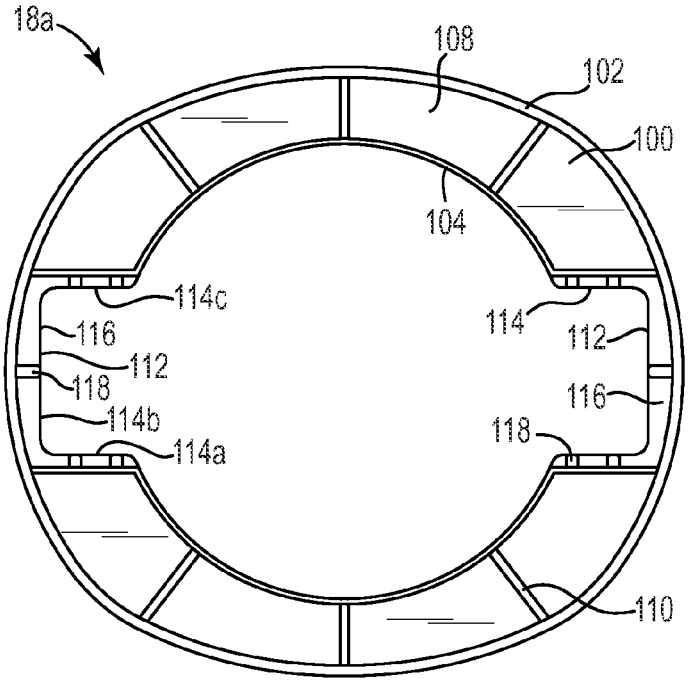
FIG. 15 is a bottom view illustration of the ring of FIG. 10, according to one embodiment of the invention.

Referring to FIGS. 3, 5, and 7, one of front panel 24 and rear panel 26 of body 20 (rear panel 26 as illustrated in FIGS. 3, 5, and 7) further comprises a recess 48 inwardly offset from the substantially planar surface 40 or 42, respectively. For example, recess 48 is a depression formed in substantially planar surface 42 of rear panel 26 of body 20. In one embodiment, recess 48 comprises an upper edge 50, a lower edge 52, an inner edge 54, and an outer edge 56, and recess surface 58. Edges 50 and 52 define upper and lower boundaries of recess 48 while inner edge 54 and outer edge 56 define opposing lateral boundaries of recess 48. Accordingly, recess 48 extends only partially laterally across a width of rear panel 26 of body 20, terminating at inner edge 54. Outer edge 56 joins with an outer edge of a corresponding one of side panels 28 providing access to recess 48 via a side of body 20. In one embodiment, substantially planar surface 42 extends around three sides (e.g., a top, bottom, and side opposite the corresponding one of side panels 28) of recess 48.

In one embodiment, recess 48 is configured to selectively maintain an information card (not shown), such as a folded information card, slide into and out of recess 48 via the side opening at outer edge 56. To facilitate the maintenance of the information card in recess 48, in one example, a bottle label (not shown) is positioned to extend over and be adhered to substantially planar surface 42 around (e.g., on three sides of) recess in a manner remaining spaced from recess surface 58 as described in U.S. Pat. No. 7,311,205, which was incorporated by reference above. In such an embodiment, inner edge 54 of recess 48 is configured to prevent further sliding movement of an information card laterally inward into recess 48, and upper edge 50 and lower edge 52 of recess 48 define guides to help maintain lateral motion of the information card in and out of recess 48, and to maintain the information card within recess 48.

In one embodiment, as shown in FIG. 1, side panels 28 of container 20 are slightly trapezoidal in shape, being interposed between front panel 24 and rear panel 26 such that each side panel 28 is slightly wider at a top portion 60 thereof (i.e., near shoulders 32) than at a bottom portion 62 thereof (i.e., near bottom panel 30). In one embodiment, one or more protruding ribs 64 are formed on each side panel 28 to facilitate enhancement of a user's grip on body 20 during use.

Substantially planar exterior surfaces 40 and 42 each curve outwardly (i.e., away from each other) at top portions 44 and 46, respectively, adjacent shoulders 32 in one embodiment. As such, an overall width of body 20 gradually increases beyond a largest width of each corresponding side panel 28. This increase in width is advantageous when pills or capsule shaped medication is placed in storage chamber 34 to allow for easy movement of the medication toward neck 22 and opening 36.

Bottle 12*a* comprises multiple distinct profiles, depending upon the view taken of bottle 12*a*, with each profile uniquely enhancing a patient's experience with bottle 12*a*. In a first view, in which a consumer directly faces front panel 24 or rear panel 26 of body 20, bottle 12*a* has a wide profile and generally flat, rectangular appearance primarily of substantially planar surface 40 or 42 of the corresponding one of front panel 24 and rear panel 26. In a second view, in which a consumer directly faces either one of side panels 28 of body 20, bottle 12 has a narrow profile and a generally flat, trapezoidal appearance (or generally cone-shaped appearance). Bottle 12*a* also includes at least one more distinct profile that is seen when directly facing bottom panel 30, which reveals a relatively narrow profile. The combination of these three distinct profiles presents pharmacy bottle 12*a*, with the distinct profiles contributing to the enhanced presentation of prescription-related information to the patient, as well as handling, storage, and retrieval of bottle 12*a*, as further described throughout this application.

In one embodiment, front panel 24 and rear panel 26 are generally symmetric with each other regarding a size and general shape (e.g., substantially rectangularly shaped) and side panels 28 are generally symmetric with each other regarding a size and general shape (e.g., substantially trapezoidally shaped). In another embodiment, front panel 24 and rear panel 26 are generally asymmetric with each other regarding a size or a general shape and side panels 28 are generally asymmetric with each other regarding a size or a general shape.

Turning back to a top portion of bottle 12*a*, in one embodiment, shoulders 32, which extend inward from each of top panel 24, bottom panel 26, and side panels 28 to a centrally located neck 22, taper inwardly to meet a substantially planar shoulder surface 80 defined by shoulder 32. Neck 22 extends from substantially planar shoulder surface 80 with a substantially perpendicular orientation relative to substantially planar shoulder surface 80. Neck 22 defines an exterior neck surface 82, which is substantially smooth, in one embodiment. Where neck 22 is threaded to receive one or both of child resistant closure 14 and non child-resistant closure 16, threads 84 extend circumferentially around the exterior neck surface. In one embodiment, two sets of opposing threads 84 are used to allow either of child resistant closure 14 and non child-resistant closure 16 to be tightly held over neck 22 without require excessive rotation of child resistant closure 14 or non child-resistant closure 16.

In one embodiment, a rib 86 is fairly narrow and circumferentially extends around an entirety of neck 22. Rib 86 is positioned between and spaced away from each of threads 84 and substantially planar shoulder surface 80. For example, rib 86 is positioned a distance away from substantially planar shoulder surface 80 to accommodate reception of one of rings 18, for instance, ring 18*a* between substantially planar shoulder surface 80 and rib 86. Wings or ledges 88 are formed at diametrically opposing portions of rib 86 and extend radially outwardly considerably farther than rib 86. For example, ledges 88 are each positioned to extend from rib 86 radially outwardly in a different direction toward a different one of side panels 28. Each ledge 88 is fairly broad and flat in nature to define a first or bottom surface 90 spaced from and facing toward substantially planar shoulder surface 80 and an opposite second or top surface 92 facing away from substantially planar shoulder surface 80. In one example, bottom surface 90 of ledge is substantially coplanar with a bottom surface of rib 86. In one embodiment, each ledge 88 has a depth measured from front to back of at least about 30% of, more preferably, at least about 40%, a outside diameter of neck. In one example, a width measured from a outermost edge of one of ledges 88 to an outermost edge of the other of ledges 88 is equal to at least about 75%, more preferably, at least about 85%, a width of the substantially planar shoulder surface 80 and/or at least about 130%, more preferably, at least about 140%, a width or outer diameter of neck 22.

Ramped extensions 94 protrude upwardly from top surface 92 of each ledge 88, according to one embodiment. For example referring to FIG. 8, each ramped extension 94 is formed on a leading half of the corresponding ledge 88, wherein the leading half is considered the first half of the corresponding ledge 88 encountered when an item or portion of one of child-resistant closure 14 or non-child resistant closure is turned clockwise to tighten the respective closure around neck 22. As illustrated with particular references to FIG. 8, each ramped extension 94 includes an angled interior surface 96 extending increasingly inwardly toward neck 22 as angled interior surface 96 travels from a leading-most edge of ramped extension 94. In one embodiment, in the above-described arrangement, one angled interior surface 96 on one side of body 20 angles increasing inward as it rearwardly extends (i.e., as it extends toward rear panel 26), and the other angled interior surface 96 on the other side of body 20 angles increasingly inward as it forwardly extends (i.e., as it extends toward front panel 24).

In one embodiment, each ledge 88 angles or tapers to a more narrow thickness near leading and trailing edges to allow features of either child resistant closure 14 or no-child resistant closure 16 to more easily interact with, more particularly, in one example, travel up and over each ledge 88 as will be further described below. In one example, stops 98 are formed by body 20 and extend upwardly from rib 86 protruding outwardly from a sidewall of neck 22. In one embodiment, stops 98 are each configured to interact with each of child-resistant closure 14 and non-child resistant closure 16 to decrease over tightening or rotation of the corresponding child-resistant closure 14 and non child-resistant closure 16. Ledge 88 is one example of means for extending radially outwardly from neck 22 and means for selectively receiving and/or interfacing with the closure and with ramped protrusions 94 is an example of means for selectively receiving the closure FIGS. 10-15 illustrate various views of ring 18*a*, which is one of the plurality of rings 18 of FIG. 1. In one embodiment, the different ones of rings 18, for example, rings 18*a*, 18*b*, 18*c*, and 18*d* are substantially identical other than coloring, surface ornamentation, etc. configured to visually associate each corresponding bottle assembly with a family or household member. More particularly, in one example, each family member or household member is assigned a color or surface ornamentation associated with one of rings 18*a*, 18*b*, 18*c*, and 18*d*. Each time the respective family or household member has a prescription filled, the same colored or ornamented ring 18*a*, 18*b*, 18*c*, or 18*d* is used on a corresponding one of bottles 12 readily visually associating each of the bottles 12 with the appropriate family or household member it corresponds with. As such, while ring 18*a* is described in detail below, it should be understood that each of the plurality of rings 18 has substantially similar structural features. In view of the above, any of rings 18 with associated color and/or surface ornamentation are means for visually associating the bottle with a patient who was prescribed a corresponding medication in comparison to other members of the household of the patient.

In one embodiment, each ring 18*a* is formed of substantially rigid, yet slightly flexible material, such as an non-elastomeric plastic or similar material, and is configured to fit around neck 22 of container 20, more specifically, to rest above planar shoulder surface 80 and sit just below ledges 88 (see FIGS. 16 and 17). In one example, ring 18*a* defines an upper panel 100, an interior wall 102, and exterior wall 104. Upper panel 100 is generally ovular in shape about an outer perimeter thereof with a substantially circular interior perimeter sized to fit just around neck 22 of bottle 12*a*. Upper panel defines an upper surface 106 and a lower surface 108 opposite upper surface 106. In one example, upper panel 100 is one of substantially planar or slightly concave. Interior wall 102 extends downwardly from the inner perimeter of upper panel 100 and is configured to interact with an outside surface of neck 22 just above planar shoulder surface 80 and just below rib 86 and ledges 88 (see FIGS. 16 and 17).

In one example, interior wall 102 extends substantially vertically downwardly from interior wall 102. Exterior wall 104 extends downwardly from the outer perimeter of upper panel 100 and, in one instance, extends substantially vertically. Exterior wall 104 provides the outermost surface of ring 18*a* having a surface ornamentation or coloration associated with ring 18*a*. In one embodiment, a substantially entirety of ring 18*a* bears the corresponding surface ornamentation or color.

Ring 18*a* remains substantially hollow or open below upper panel 100 and between interior and exterior walls 102 and 104, according to one embodiment. Reinforcement fins 110 (see FIGS. 11 and 15) extend within the hollow space of ring 18*a* between interior wall 102 and exterior wall 104 to provide additional rigidity and strength to ring 18*a*. In one example, indentations 112 are collectively defined by upper panel 100 and interior wall 102 in a substantially rectangular shape or other shape substantially identical to the shape of ledges 88 of bottle 12*a* (see FIGS. 2-9 and 16 and 17) and are diametrically opposed to one another. Indentations 112 are formed centered along a lateral centerline of ring 18*a*. Each indentation 112 defines three sides 114, more particularly including a first side 114*a* extending from interior wall 102 radially outwardly nearly to exterior wall 104, a second side 114 extending just inside exterior wall 104 and having a curvilinear shape mimicking the curvilinear shape of a coextending portion of exterior wall 104, and a third side 116 similar to first side 114*a*, but on an opposite side of second side 114*b*. In one embodiment, a flange 116 extends along each side 114*a*, 114*b*, and 114*c* in a direction substantially perpendicular to interior wall 102 and exterior wall 104 and positioned about half way between upper panel 100 and a bottom of ring 18*a*. In one example, reinforcement tabs 118 are positioned on either side (i.e., top and/or bottom) of flange 116 to provide additional strength and rigidity to flange 116.

Figure 16:
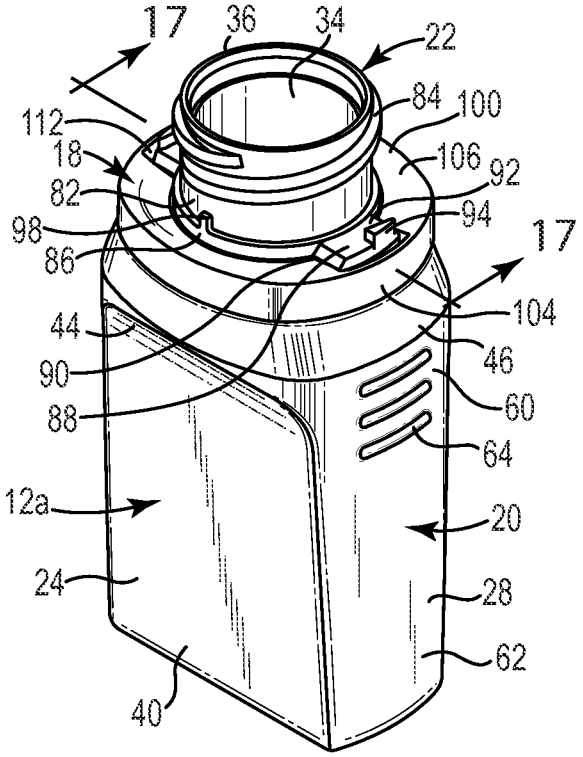
FIG. 16 is a front, top, and perspective view illustration of a partially assembled container including the first bottle in FIG. 1 and the ring of FIG. 10, according to one embodiment of the invention.
Figure 17:
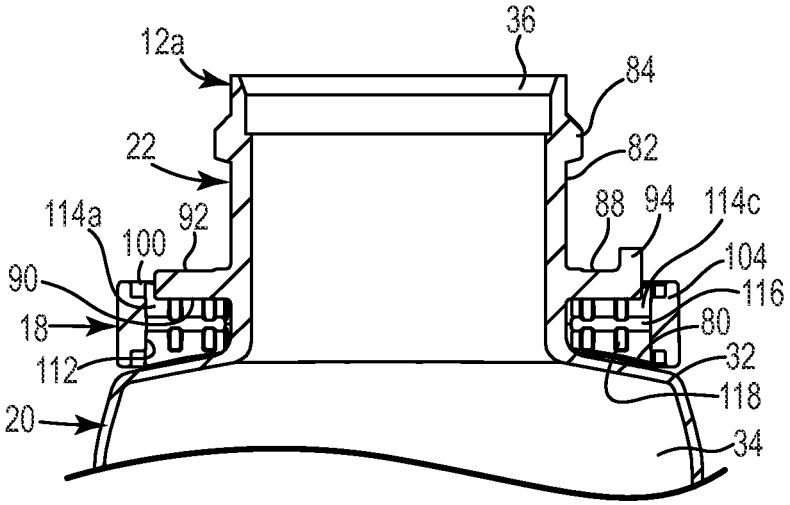
FIG. 17 is a cross-sectional view illustration of the partially assembled container taken along line 17-17 in FIG. 16, according to one embodiment of the present invention.
Figure 18:
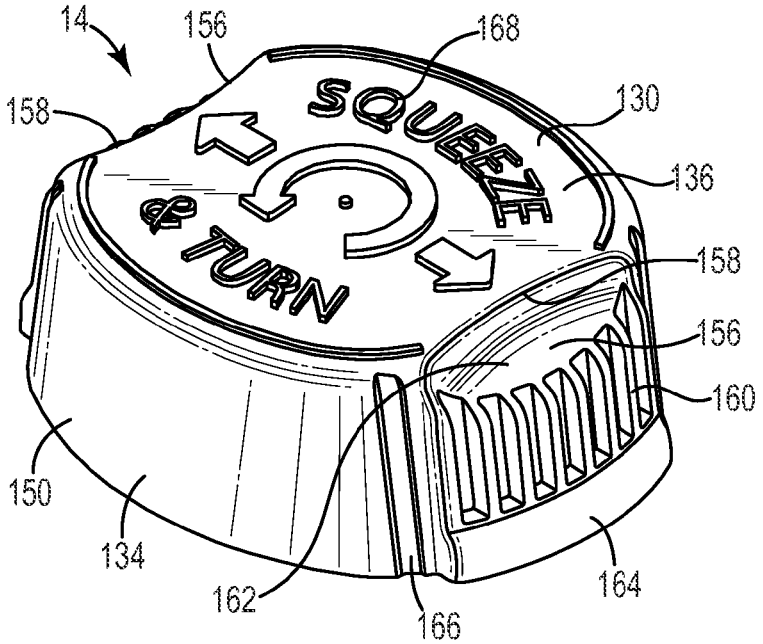
FIG. 18 is a front, top, and perspective view illustration of a child-resistant closure of the plurality of closures in FIG. 1, according to one embodiment of the invention.
Figure 19:
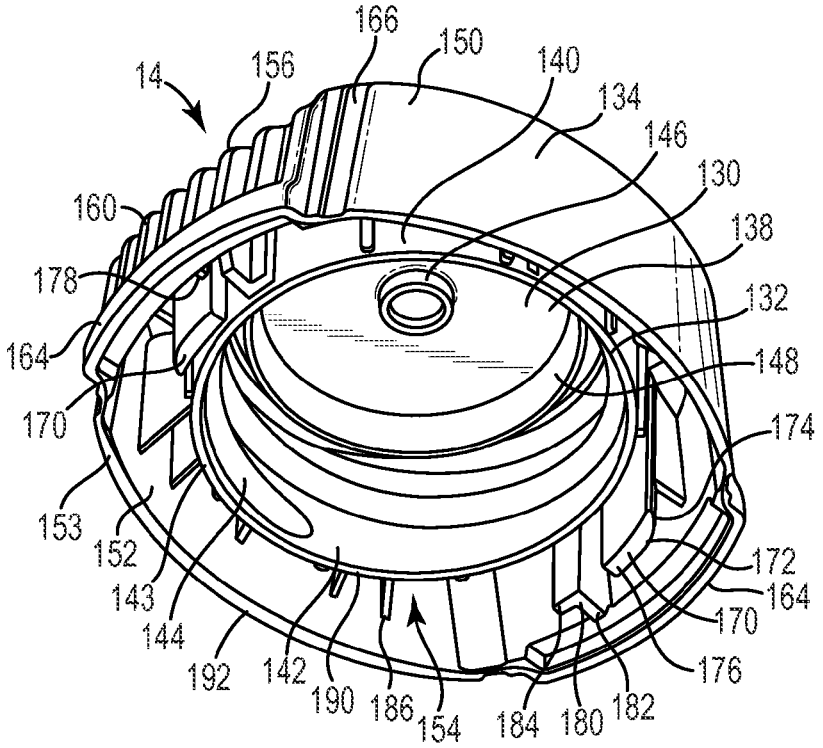
FIG. 19 is a rear, bottom, and perspective view illustration of the child-resistant closure of FIG. 18, according to one embodiment of the invention.
Figure 20:
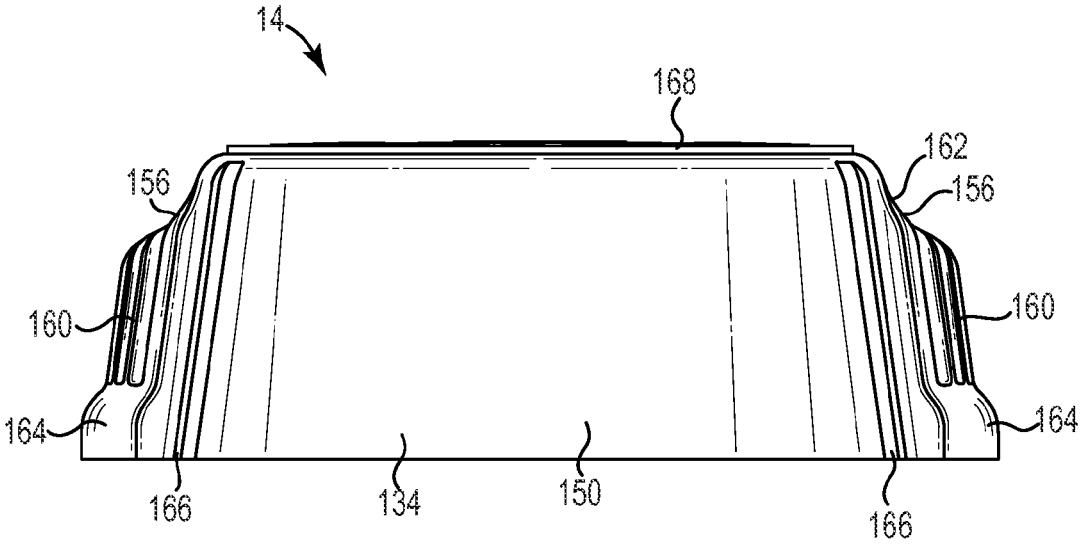
FIG. 20 is a front view illustration of the child-resistant closure of FIG. 18, according to one embodiment of the invention.
Figure 21:
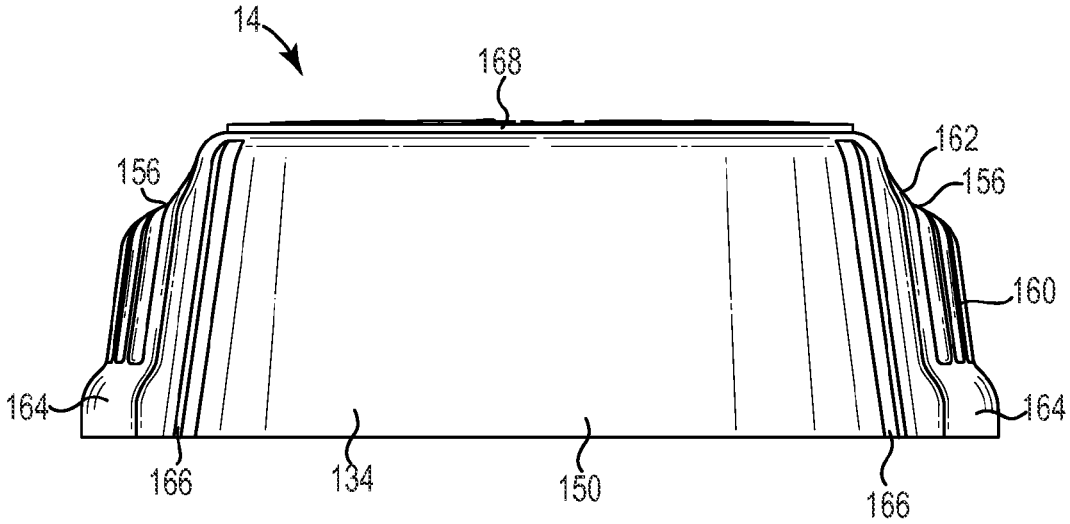
FIG. 21 is a rear view illustration of the child-resistant closure of FIG. 18, according to one embodiment of the invention.
Figure 22:
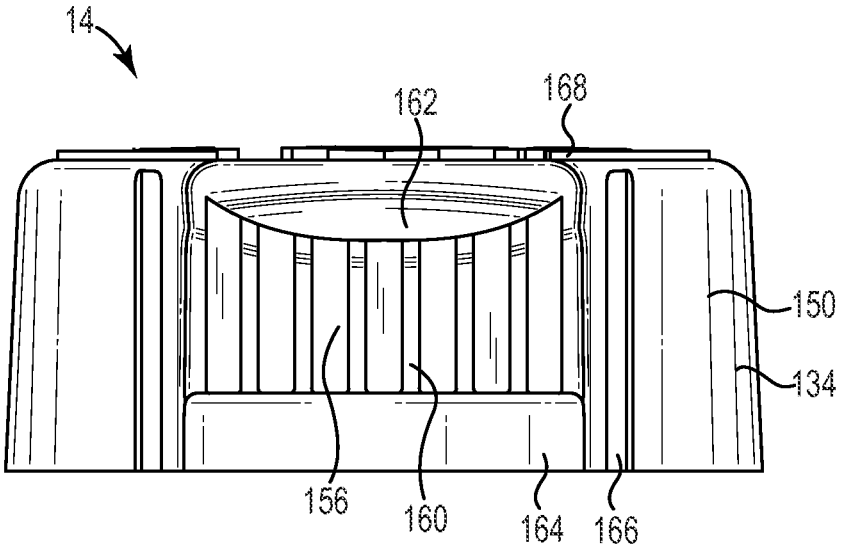
FIG. 22 is a right side view illustration of the child-resistant closure of FIG. 18, according to one embodiment of the invention.
Figure 23:
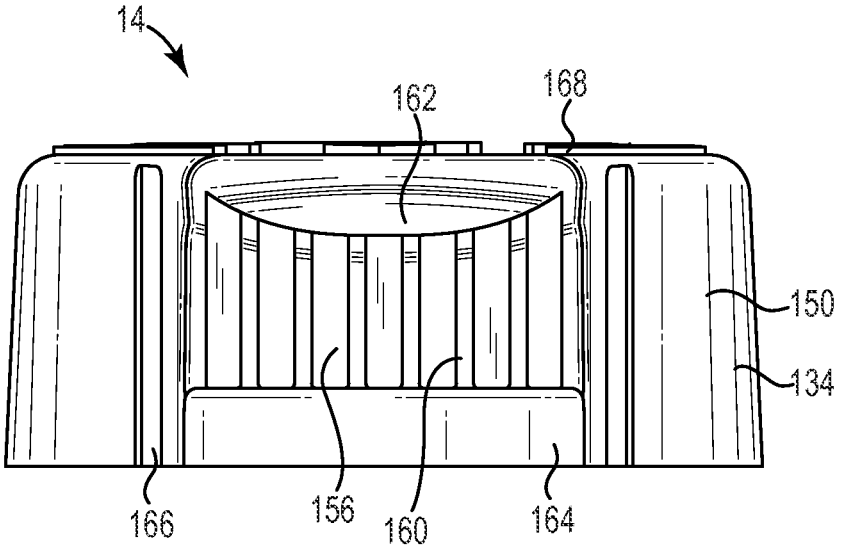
FIG. 23 is a left side view illustration of the child-resistant closure of FIG. 18, according to one embodiment of the invention.
Figure 24:
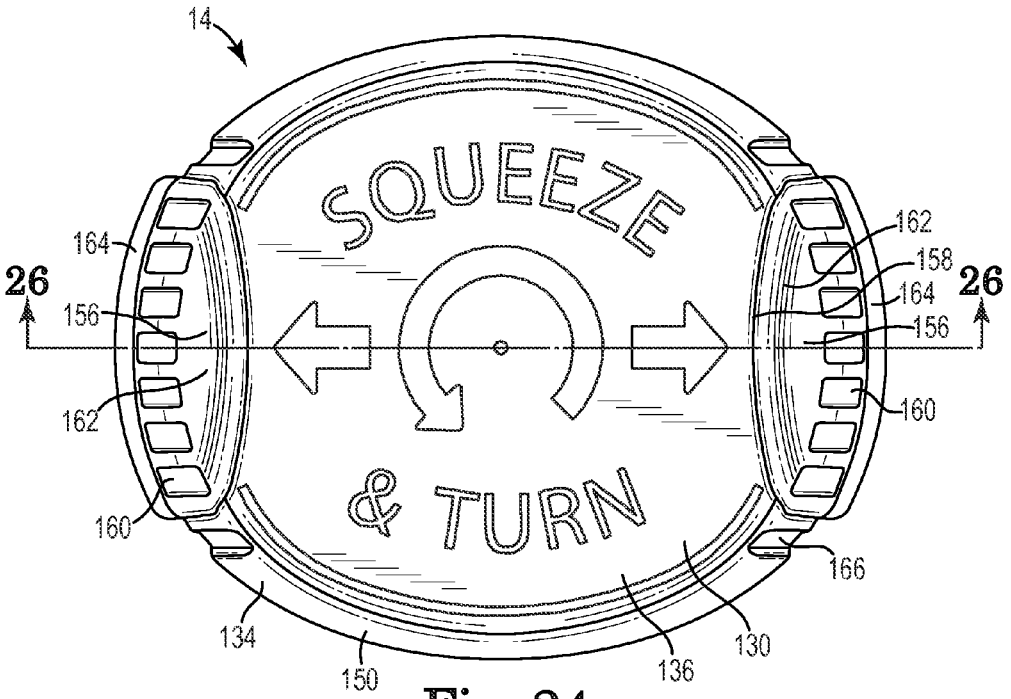
FIG. 24 is a top view illustration of the child-resistant closure of FIG. 18, according to one embodiment of the invention.
Figure 25:
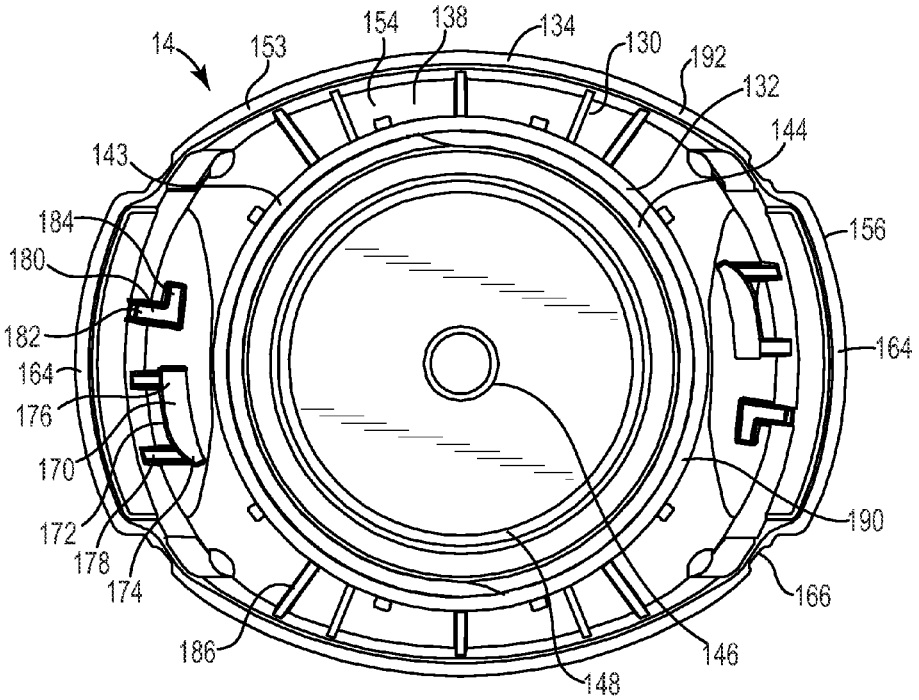
FIG. 25 is a bottom view illustration of the child-resistant closure of FIG. 18, according to one embodiment of the invention.
Figure 26:
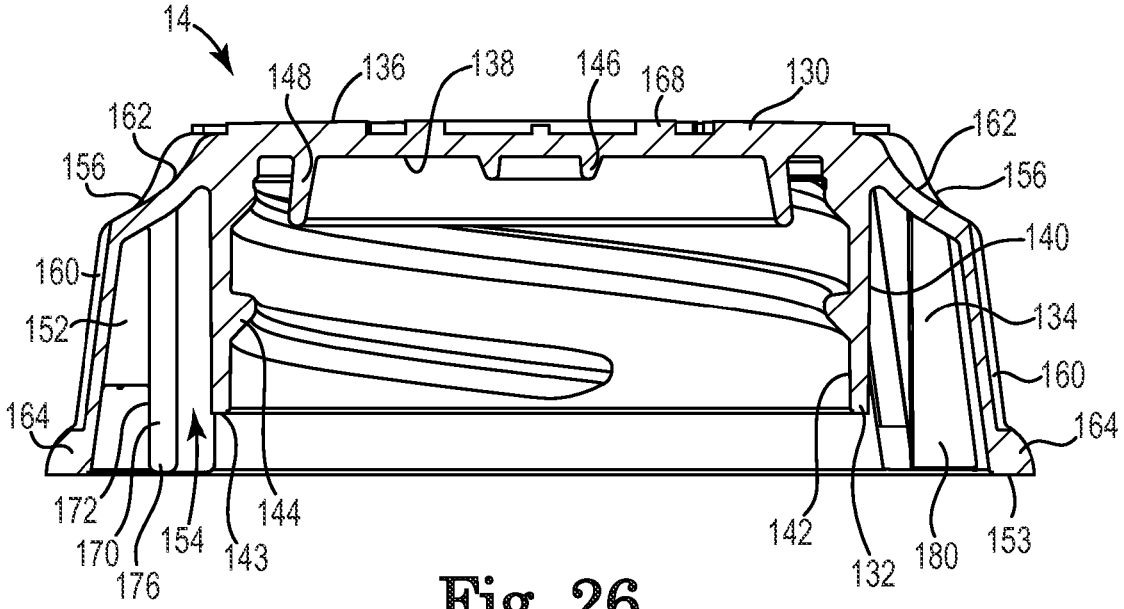
FIG. 26 is a cross-sectional view illustration of the child-resistant closure taken along line 26-26 in FIG. 24, according to one embodiment of the present invention.
Figure 27:
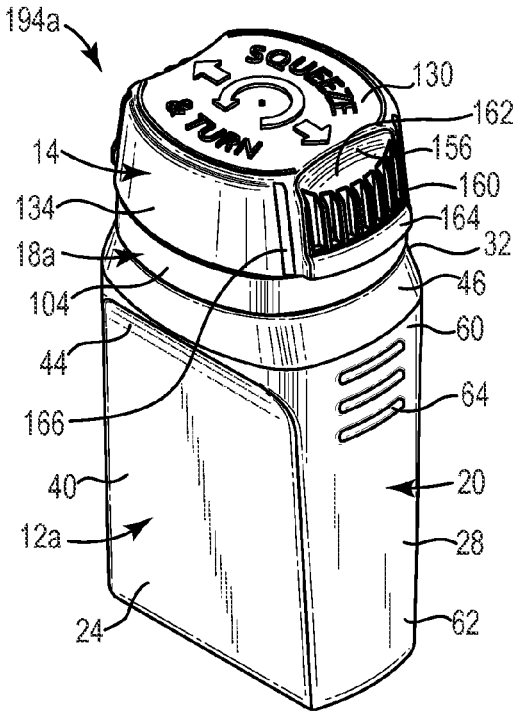
FIG. 27 is a front, top, and perspective view illustration of a first assembled container including the first bottle in FIG. 1, the ring of FIG. 10, and the child-resistant closure of FIG. 18, according to one embodiment of the invention.
Figure 28:
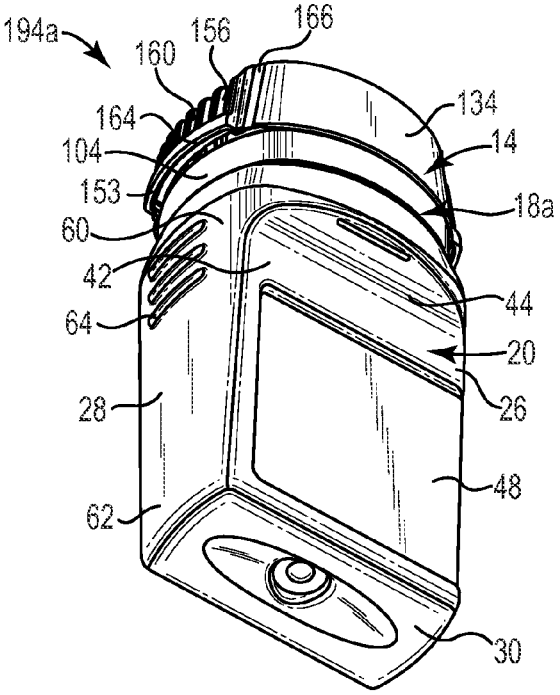
FIG. 28 is a rear, bottom, and perspective view illustration of the first assembled container of FIG. 27, according to one embodiment of the invention.
Figure 29:
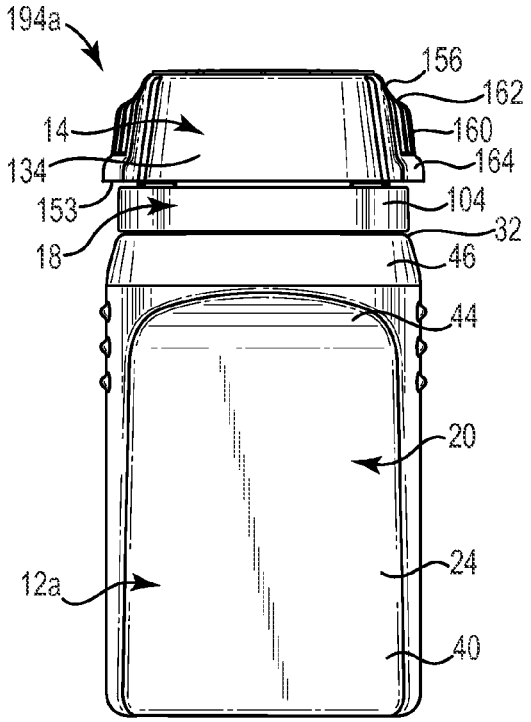
FIG. 29 is a front view illustration of the first assembled container of FIG. 27, according to one embodiment of the invention.
Figure 30:
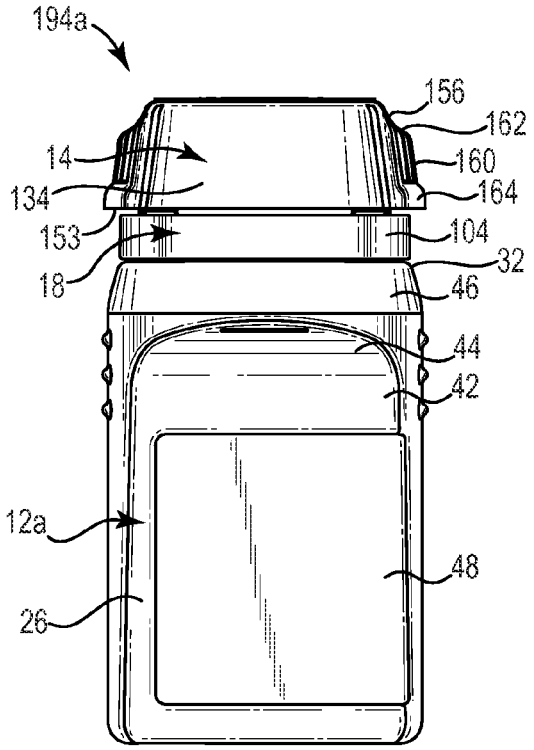
FIG. 30 is a rear view illustration of the first assembled container of FIG. 27, according to one embodiment of the invention
Figure 31:
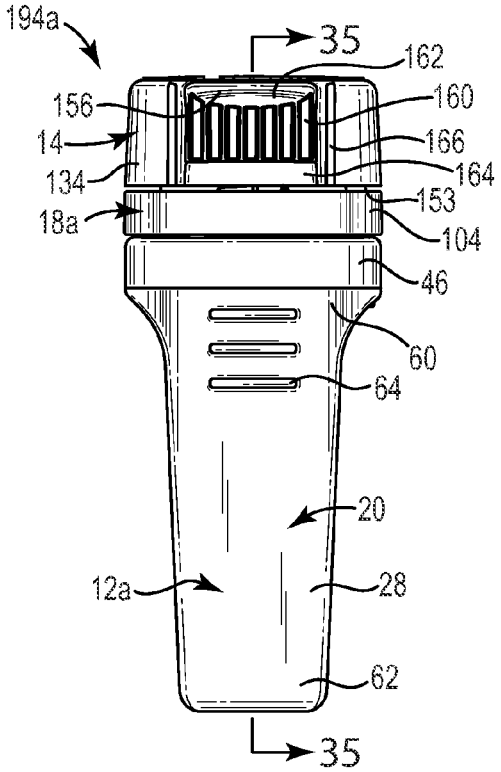
FIG. 31 is a right side view illustration of the first assembled container of FIG. 27, according to one embodiment of the invention.
Figure 32:
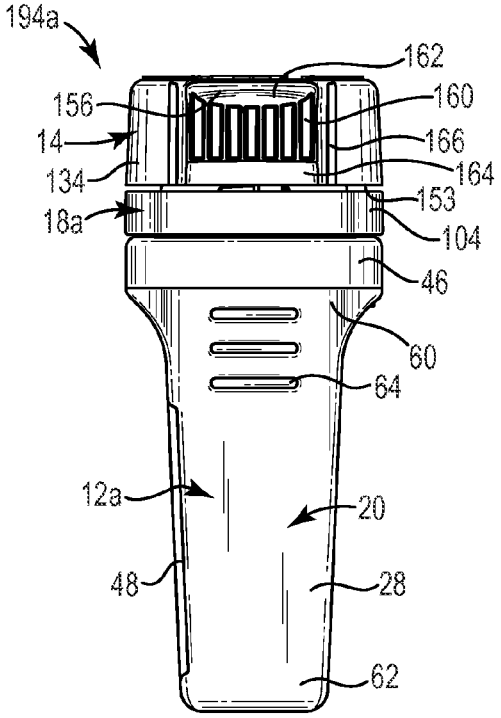
FIG. 32 is a left side view illustration of the first assembled container of FIG. 27, according to one embodiment of the invention.
Figure 33:
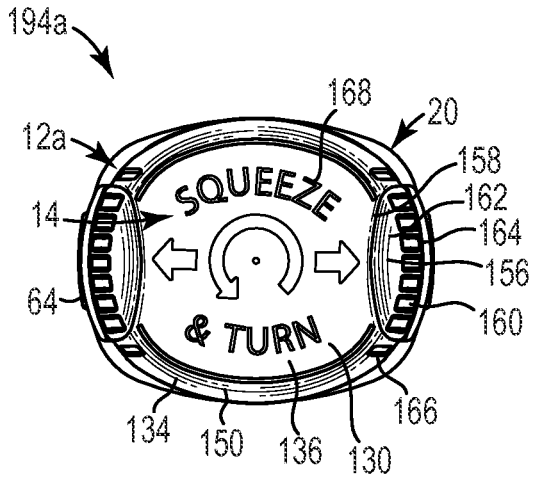
FIG. 33 is a top view illustration the first assembled container of FIG. 27, according to one embodiment of the invention.
Figure 34:
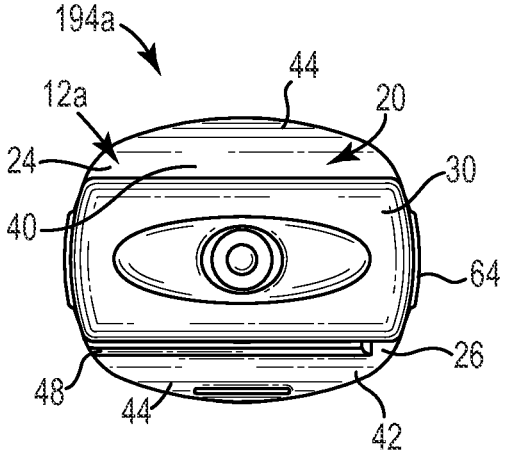
FIG. 34 is a bottom view illustration the first assembled container of FIG. 27, according to one embodiment of the invention.
Figure 35:
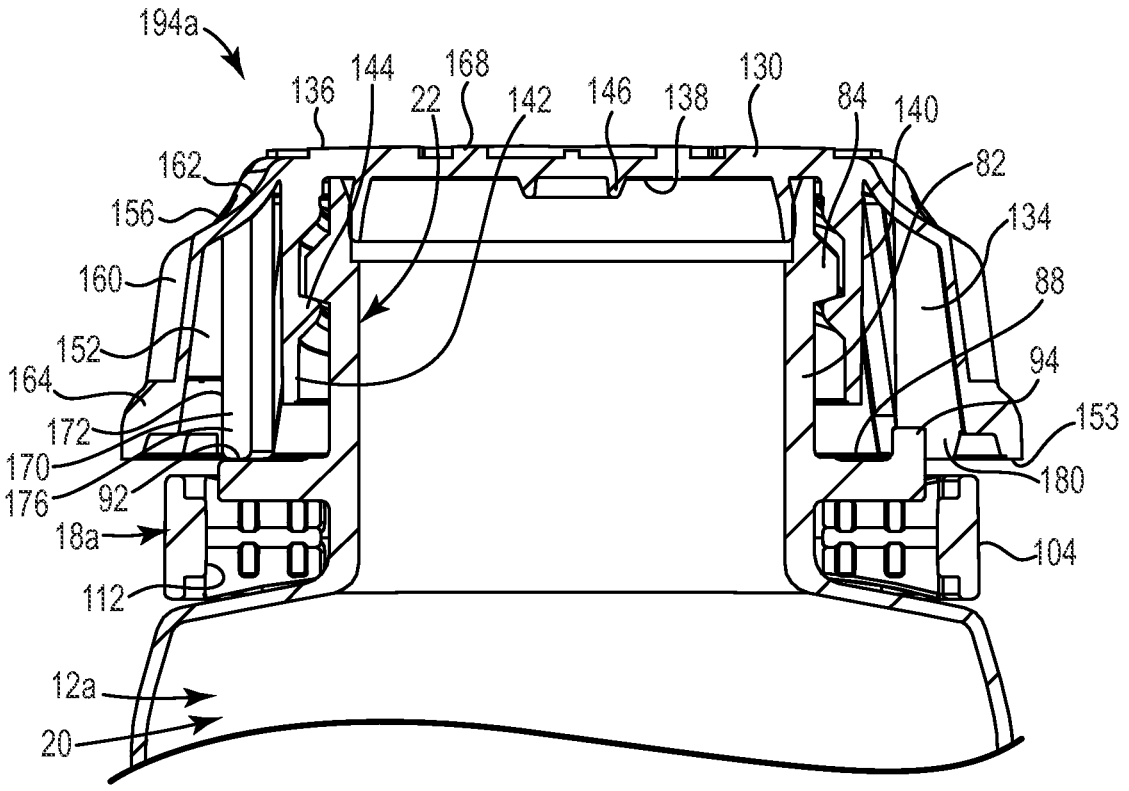
FIG. 35 is a cross-sectional view illustration of the first assembled container taken along line 35-35 in FIG. 31, according to one embodiment of the present invention.
Figure 36:
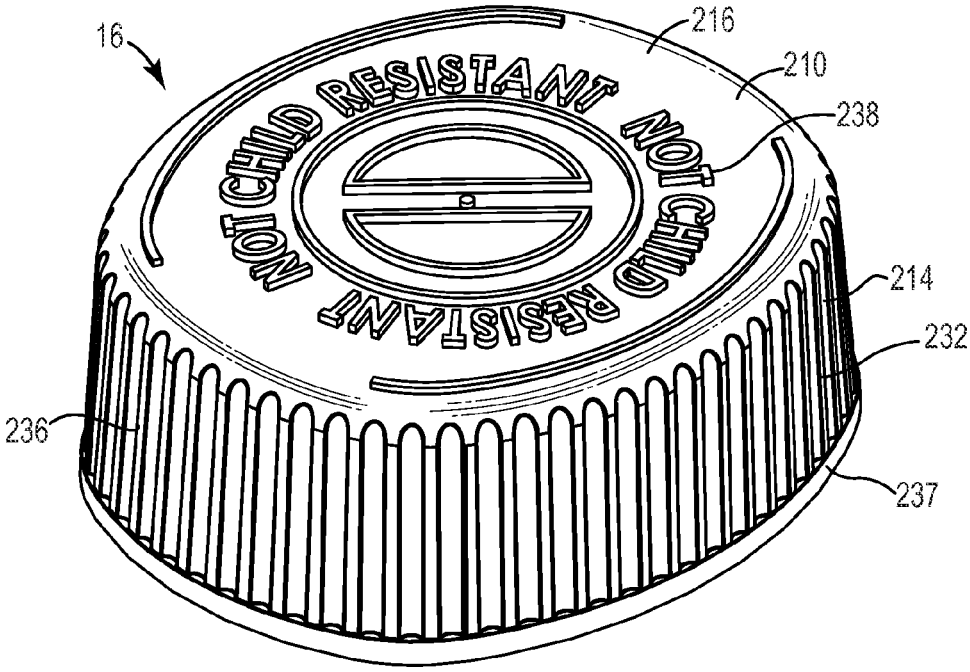
FIG. 36 is a front, top, and perspective view illustration of a non child-resistant closure of the plurality of closures in FIG. 1, according to one embodiment of the invention.
Figure 37:
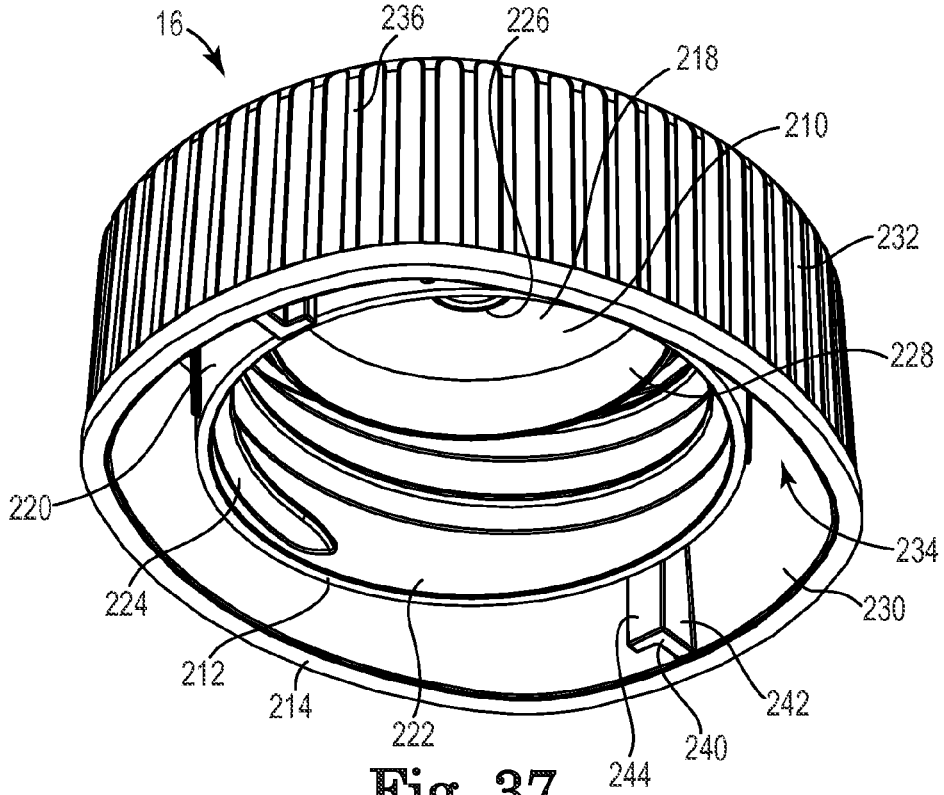
FIG. 37 is a rear, bottom, and perspective view illustration of the non child-resistant closure of FIG. 18, according to one embodiment of the invention.
Figure 38:
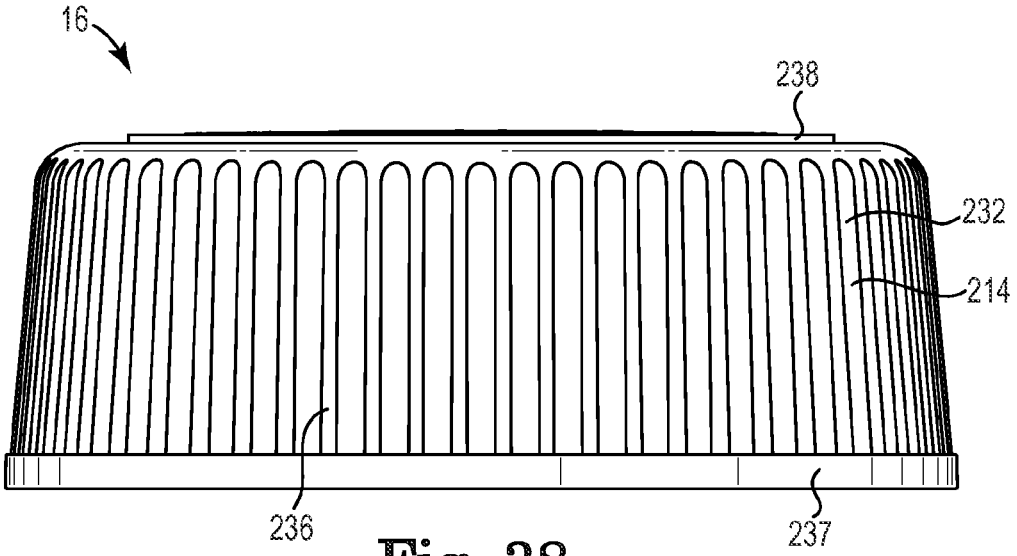
FIG. 38 is a front view illustration of the non child-resistant closure of FIG. 36, according to one embodiment of the invention.
Figure 39:
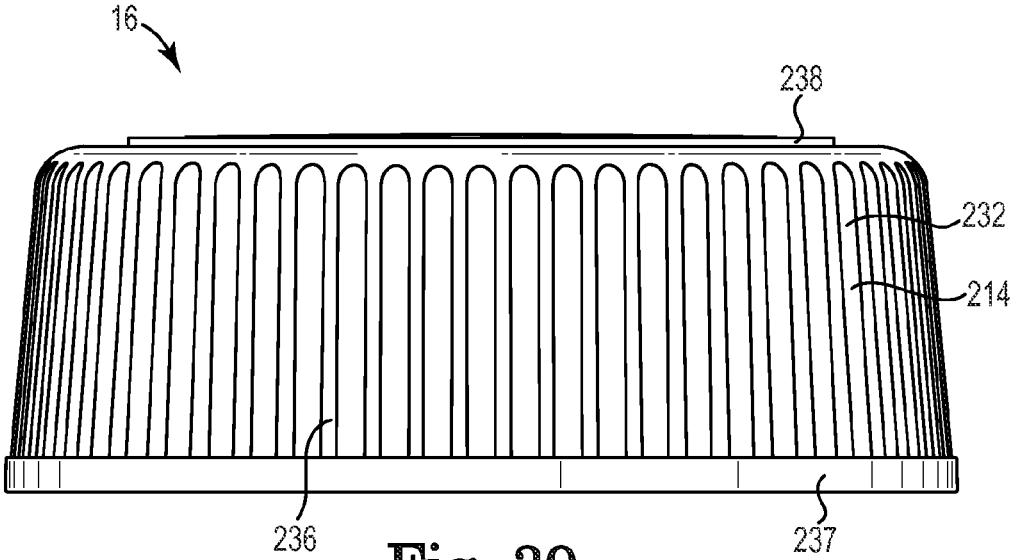
FIG. 39 is a rear view illustration of the non child-resistant closure of FIG. 36, according to one embodiment of the invention.
Figure 40:
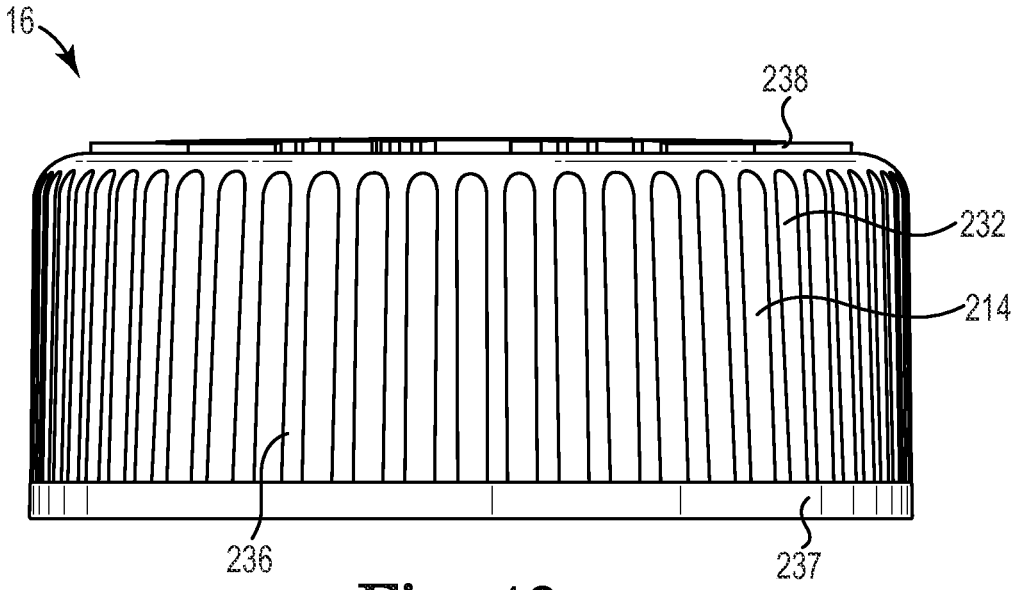
FIG. 40 is a right side view illustration the non child-resistant closure of FIG. 36, according to one embodiment of the invention.
Figure 41:
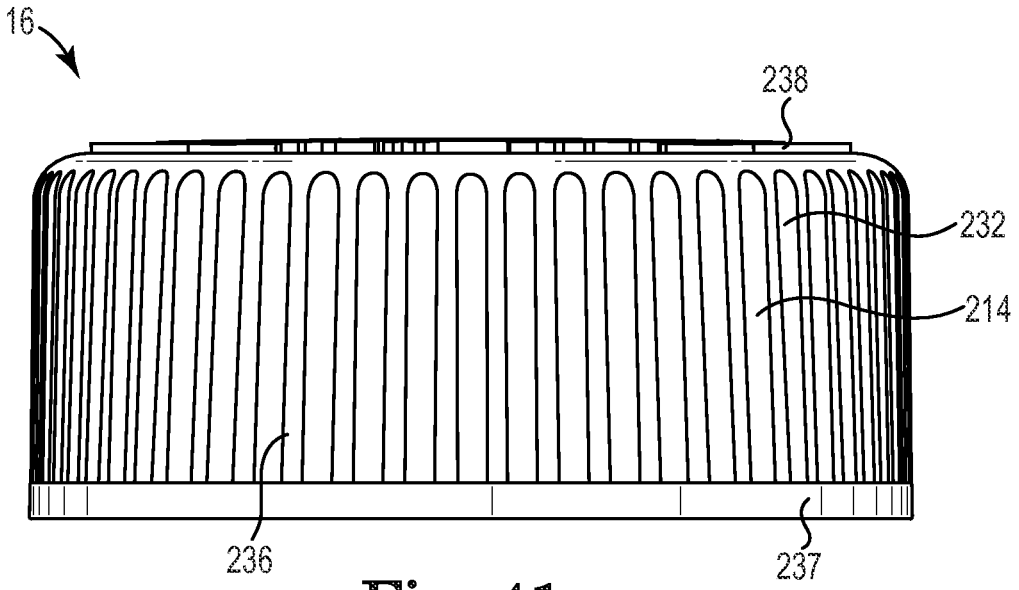
FIG. 41 is a left side view illustration of the non child-resistant closure of FIG. 36, according to one embodiment of the invention.
Figure 42:
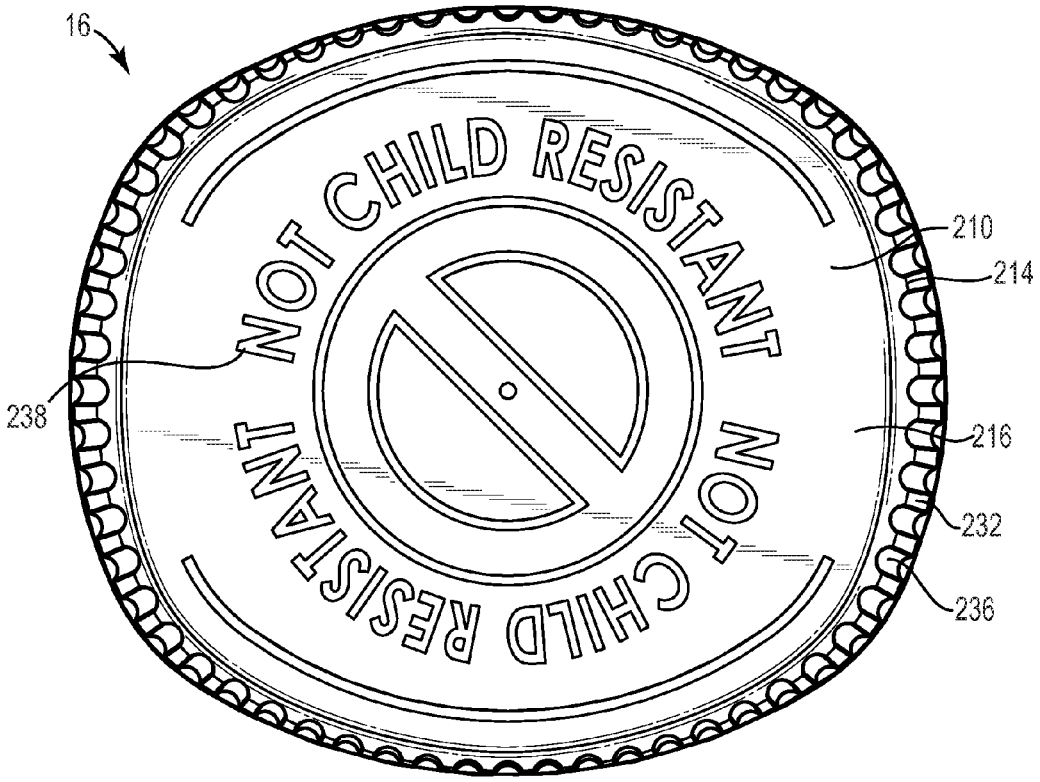
FIG. 42 is a top view illustration of the non child-resistant closure of FIG. 36, according to one embodiment of the invention.
Figure 43:
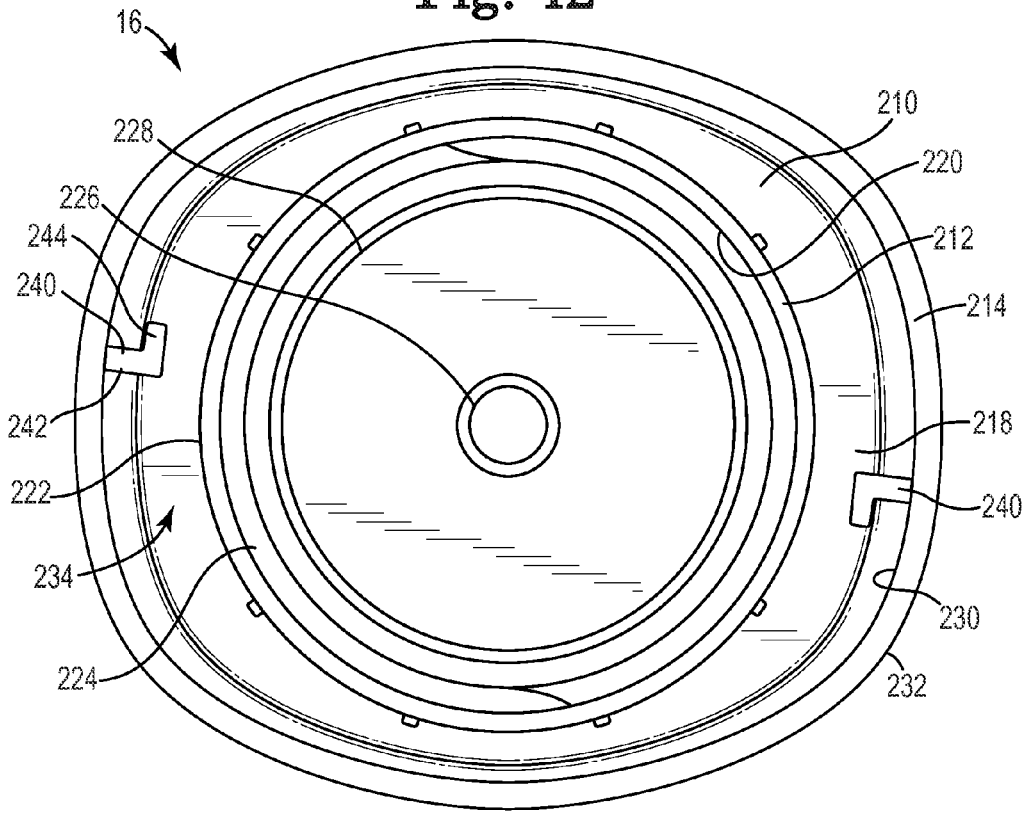
FIG. 43 is a bottom view illustration of the non child-resistant closure of FIG. 36, according to one embodiment of the invention.

While substantially rigid, ring 18*a* is configured to slightly flex to fit over neck 22 and ledges 88 of bottle 12 as illustrated, for example, in FIGS. 16 and 17. More particularly, by applying force to ends of ring 18*a* just outside indentations 112, ring 18*a* flexes and ring 18*a* is able to slide down around neck 22, indentations 112 over ledges 88, and onto bottle 12*a*. When unflexed, flange 116 and tabs 118 fit below ledges 88 securing ring 18*a* to bottle 12*a*, more particularly, between substantially planar shoulder surface 80 of bottle 12*a*, such that ring 18*a* is not easily removed therefrom. In one embodiment, all bottles 12*a*, 12*b*, 12*c*, and 12*d* in pharmacy container system 10 have necks 22 and ledges 88 of substantially identical sizes such that rings 18 of substantially identical sizes can be used on all of bottles 12*a*, 12*b*, 12*c*, and 12*d* thereby decreasing the total number of inventoried items kept on hand.

FIGS. 18-26 illustrate child-resistant closure 14, according to one embodiment of the present invention. As illustrated, child-resistant closure 14 includes a top panel 130, an inner sidewall or inner skirt 132, and an outer sidewall or outer skirt 134. Top panel 130 is ovular, although other suitable shapes are also contemplated, and defines an exterior surface 136 and an interior surface 138 opposite exterior surface 136. Inner skirt 132 is circular, configured to interface with neck 22 of bottle 12*a*, and extends downwardly from and is centered on interior surface 138 of top panel 130. Inner skirt 132, more particularly, defines an outer surface 140, an inner surface 142 opposite outer surface 140, and a bottom edge 143. Inner skirt 132 is threaded, for example, double threaded, to interface with threads 84 around neck 22 to securely hold child-resistant closure 14 on neck 22 and over opening 36.

In one example, child-resistant closure 14 additionally includes an inner ring 146 and an outer ring 148 both protruding downwardly from interior surface 138 of top panel 130 inside inner skirt 132. Inner ring 146 and outer ring 148 are configured to interface with bottle inserts (not shown) to assist in housing and dispensing liquid medications (not shown) in a liquid-tight manner.

Outer skirt 134 extends downwardly from the outermost perimeter of top panel 130, in one example, with a slight outward flare. A bottom-most edge of outer skirt 134 has an outer perimeter, at least along front and back portions, that is substantially coterminous with an outer perimeter of ring 18*a*. In one embodiment, outer skirt 134 includes an outer surface 150, an inner surface 152 opposite outer surface 150, and a bottom edge 153. As illustrated, a void 154 is defined between outer surface 140 of inner skirt 132 and inner surface 152 of outer skirt 134. Void 154 allows outer skirt 134 to deform under outside forces even while inner skirt 132 is secured around neck 22 of bottle 12*a*. In one embodiment, outer skirt 134 extends further away from top panel 130 than inner skirt 132 such that a bottom edge 190 of inner skirt 132 is positioned nearer top panel 130 than a bottom edge 192 of outer skirt 134.

Outer skirt 134, in one embodiment, includes opposing grip sections 156 on opposite sides of outer skirt 134 coupled to a remainder of outer skirt 134 on each side by a transitional section 166, which is substantially thinner than a remainder of outer skirt 134. The thin transitional section 166 permits deflection of opposing grip sections 156 relative to the rest of outer skirt 134 when external force (i.e., pinching by a user) squeezes the opposing grip sections 156 toward one another. In one embodiment, grip sections 156 are configured with various features facilitating a user in gripping and squeezing the appropriate portions of child-resistant closure 14. For example, each grip section 156 includes a concave recess 158, which forms an outer void 163, as it transitions from top panel 130, followed by elongated and generally downwardly extending grip ribs 160 arranged in a row along a substantially entirety of the width of each grip section 156. Grip sections 156 each include a horizontally extending berm 196 extending between grip ribs 160 and bottom edge 243 of outer skirt 134, which may bump out, as illustrated, or extend substantially downwardly to further facilitate a user in properly grasping and squeezing grip sections 156, according to one embodiment. FIGS. 70-76 illustrate an alternative child-resistant closure 200 that is substantially similar to child-resistant closure 154 other than berm 196 and other minor differences that will be apparent to those of skill in the art comparing the drawings.

Returning to FIGS. 18-26, in one example, child-resistant closure 14 additionally includes raised indicia 168 protruding slightly upwardly from exterior surface 136 of top panel 130 and providing instructions to a user for interacting with child-resistant closure 14. For example, raised indicia 168 may include text and graphic indications instructing a user to squeeze grip sections 156 and turn child-resistant closure 14 to remove child-resistant closure 14 from the respective bottle 12*a* to open bottle 12*a* and access its contents.

In one example, child-resistant closure 14 includes additional features positioned between inner skirt 132 and outer skirt 134 to establish child-resistant closure 14 as being truly child-resistant. In one embodiment, the additional features of child-resistant closure 14 include ramps 170 and stops 180. One of ramps 170 is positioned to extend into void 154 from inner surface 152 of outer skirt 134 and extends downwardly below bottom edge 190 of inner surface 152 to define an inclined or ramped surface 172 angled radially outwardly as it extends from a leading end 174 to a trailing end 176. In one example, each ramp 170 is supported by supports 178 extending from inner surface 152 of outer skirt 134. In this manner, ramps 170 are angled and configured to interface with ramped extensions 94 such that each ramp 170 easily slides over and past a corresponding ramped extension 94 of bottle 12*a* when child-resistant closure 14 is turned clockwise due to the angles of ramped extensions 94 and ramp 170. The same angles of ramped extensions 94 and ramp 170 make it substantially difficult, i.e., near impossible for a child, to move turn child-resistant closure 14 counterclockwise to move ramp 170 back over and past ramped extensions 94 to remove child resistant closure 14 from bottle 12*a*.

One of stops 180 is positioned to extend inwardly from inner surface 152 of outer skirt 134, more specifically, grip sections 156 of outer skirt 134, spaced just slightly from trailing end 176 of each ramp 170. Each stop 180 is configured to interface with one of ramped extensions 94 of bottle 12*a* to prevent over-rotation or tightening of child-resistant closure 14 relative to neck 22 of bottle 12*a* and extends below bottom edge 190 of inner skirt 132. In one example, each stop 180 is substantially L-shaped and includes a radially extending portion 182 and a circumferentially extending portion 184, wherein each ramped extension 94 of bottle 12*a* primarily interacts with radial portion 182 to stop rotation thereof.

In one embodiment, child resistant closure 14 additionally includes various reinforcing fins 186 extending from front and back portions between inner surface 152 of outer skirt 134 and outer surface 140 of inner skirt 132. Reinforcing fins 186 provide additional rigidity to child resistant closure 14 without impeding flexing of grip sections 156. For example, flexing of grip sections 156 is used to allow an adult, i.e., a non-child, to remove child-resistant closure 14 from bottle 12*a*. In particular, when an adult user applies forces by squeezing grip ribs 160 of opposing sides toward one another, ramps 170 are moved inwardly to clear ramped protrusions 94 of bottle 12*a* and child-resistant closure is rotated while grip portions are squeezed to release child-resistant closure 14 from bottle 12*a* exposing opening 36 and allowing access to the contents of bottle 12*a*. One example, of an assembled container 194*a* including bottle 12*a*, ring 18*a*, and one child-resistant closure 14 is illustrated with additional detail in FIGS. 27-35.

In one embodiment, in addition to being configured to stand upright from bottom panel 30, bottle 12*a* is also configured to stand upright on a support surface (not shown), such as a table or counter, from top panel 120 of child-resistant closure 14. In this orientation, bottom panel 30 is considered a top of bottle 12*a* while child-resistant closure 14 is considered a bottom of bottle 12*a*. This orientation can also be achieved by manually holding bottle 12*a* with bottom panel 30 in a relatively higher position relative to child-resistant closure 14. Label (not shown) may include information configured to be read in either orientation (i.e., bottom panel 30 down or child-resistant closure 14 down) to establish one of the two orientations as the primary orientation.

FIGS. 36-43 illustrate a non child-resistant closure 16 for use on any of bottles 12*a*, 12*b*, 12*c*, and 12*d* as an alternative to child-resistant closure 14. In one embodiment, includes a top panel 210, an inner skirt 212, and an outer skirt 214. Top panel 210 is ovular, although other suitable shapes are also contemplated, and defines an exterior surface 216 and an interior surface 218 opposite exterior surface 216. Inner skirt 212 is circular, configured to interface with neck 22 of bottle 12*a*, and extends downwardly from and is centered on interior surface 218 of top panel 210. Inner skirt 212, more particularly, defines an inner surface 220 and an outer surface 222 opposite inner surface 220. Inner skirt 212 is threaded, for example, double threaded, to interface with threads 84 around neck 22 to securely and selectively hold non child-resistant closure 16 on neck 22 and over opening 36 of bottle 12*a*.

In one example, non child-resistant closure 16 additionally includes an inner ring 226 and an outer ring 228 both protruding downwardly from interior surface 218 of top panel 210 inside inner skirt 212. Inner ring 226 and outer ring 228 are configured to interface with bottle inserts (not shown) to assist in housing and dispensing liquid medications (not shown) in a liquid-tight manner similar to inner ring 146 and outer ring 148 of child-resistant closure 14.

Outer skirt 214 extends downwardly from the outermost perimeter of top panel 210, in one example, with a slight outward flare. A bottom-most edge of outer skirt 214 has an outer perimeter that is substantially coterminous with an outer perimeter of ring 18*a*. In one embodiment, outer skirt 214 includes an inner surface 230, an outer surface 232, and a void 234 is defined between outer surface 222 of inner skirt 212 and inner surface 230 of outer skirt 214. Void 234 allows outer skirt 214 to deform under outside forces even while inner skirt 212 is secured around neck 22 of bottle 12*a*. In one embodiment, outer skirt 214 extends further away from top panel 210 than inner skirt 212. In one embodiment, elongated grip ribs 236 extend up and down, stacked circumferentially around outer surface 234 of outer skirt 214. As illustrated, non child-resistant closure 16 defines a smooth bottom rim 237 extending just below elongated grip ribs 236.

Figure 44:
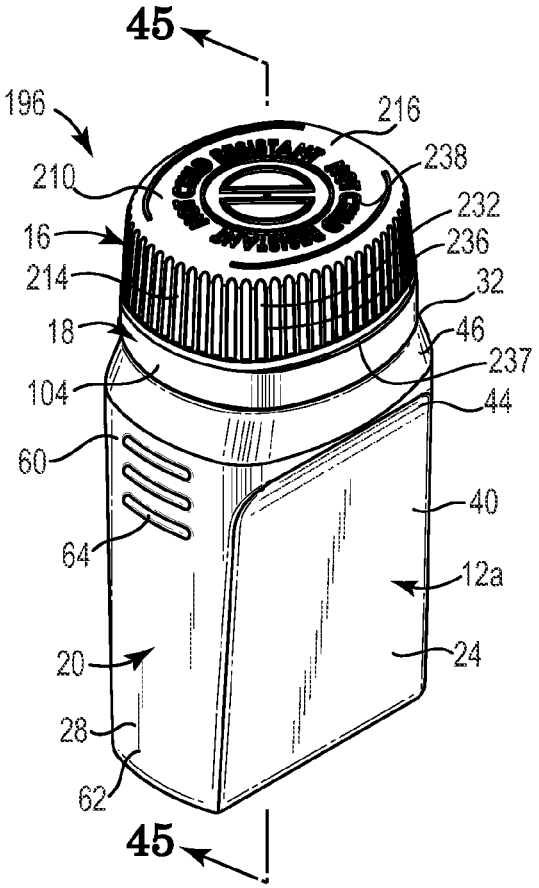
FIG. 44 is a front, top, and perspective view illustration of a non-child resistant assembled container including the first bottle in FIG. 1, the ring of FIG. 10, and the non child-resistant closure of FIG. 36, according to one embodiment of the invention.
Figure 45:
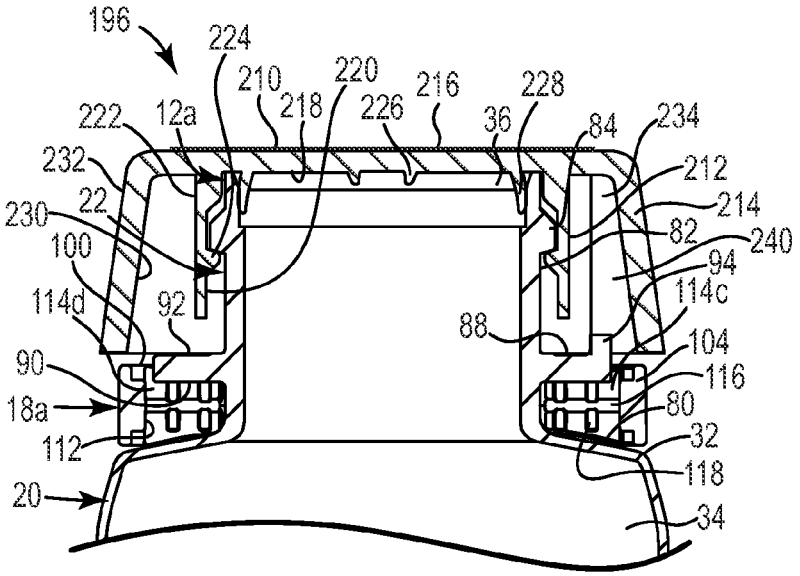
FIG. 45 is a cross-sectional view illustration of the non-child resistant assembled container taken along the line 45-45 in FIG. 44, according to one embodiment of the present invention.
Figure 46:
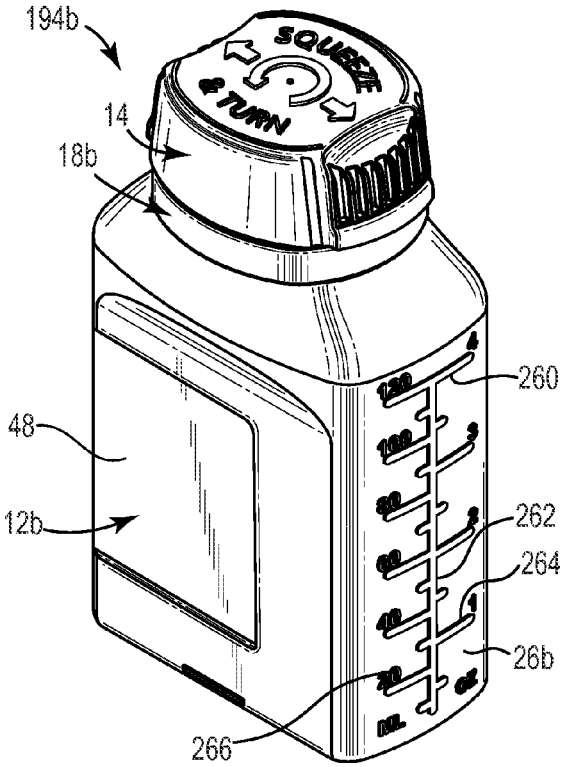
FIG. 46 is a front, top, and perspective view illustration of a second assembled container of the pharmacy system of FIG. 1, according to one embodiment of the invention.
Figure 47:
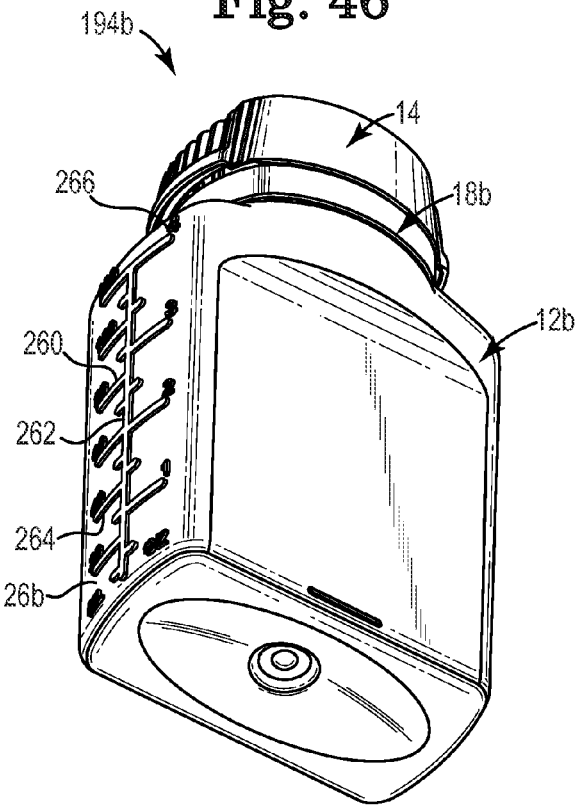
FIG. 47 is a rear, bottom, and perspective view illustration of the second assembled container of FIG. 46, according to one embodiment of the invention.
Figure 48:
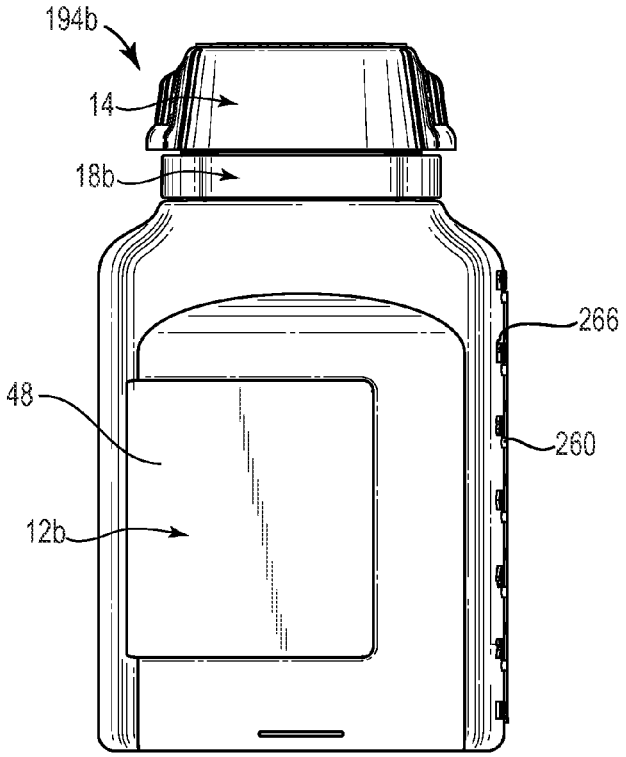
FIG. 48 is a front view illustration of the second assembled container of FIG. 46, according to one embodiment of the invention.
Figure 49:
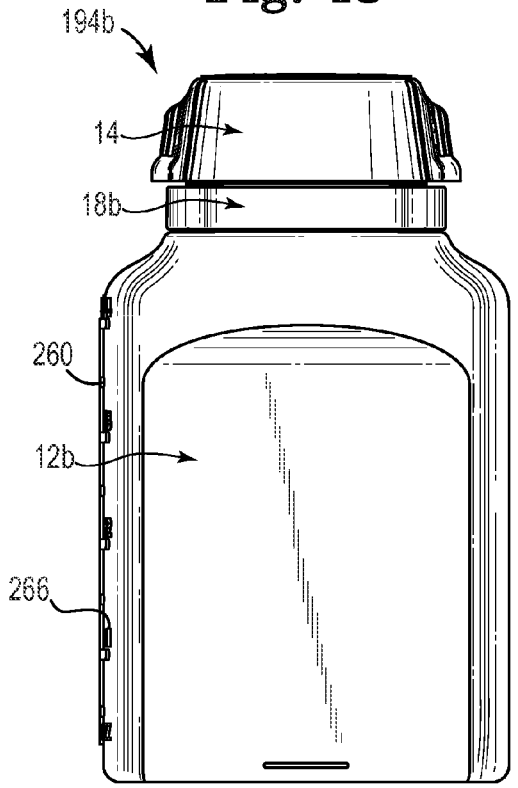
FIG. 49 is a rear view illustration of the second assembled container of FIG. 46, according to one embodiment of the invention.
Figure 50:
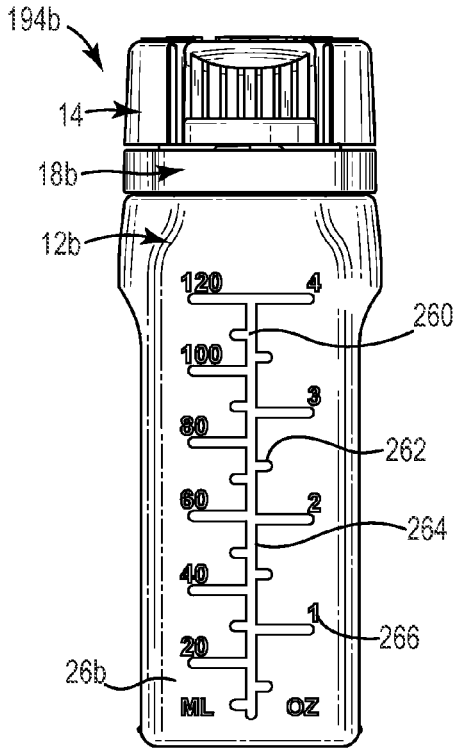
FIG. 50 is a right side view illustration of the second assembled container of FIG. 46, according to one embodiment of the invention.
Figure 51:
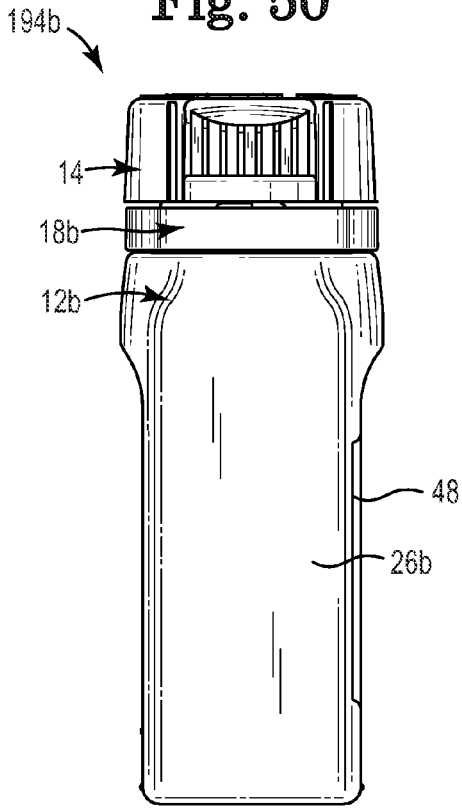
FIG. 51 is a left side view illustration of the second assembled container of FIG. 46, according to one embodiment of the invention.
Figure 52:
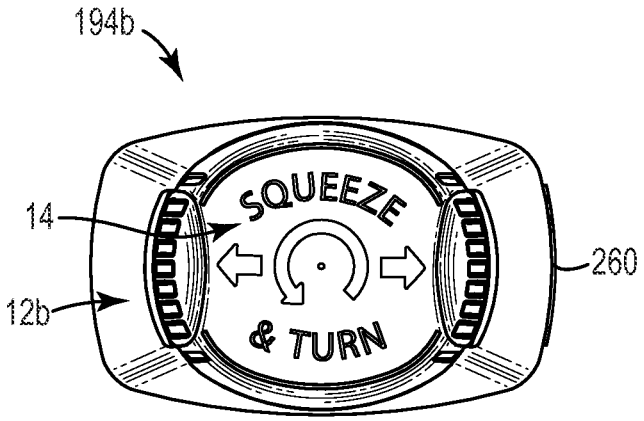
FIG. 52 is a top view illustration of the second assembled container of FIG. 46, according to one embodiment of the invention.
Figure 53:
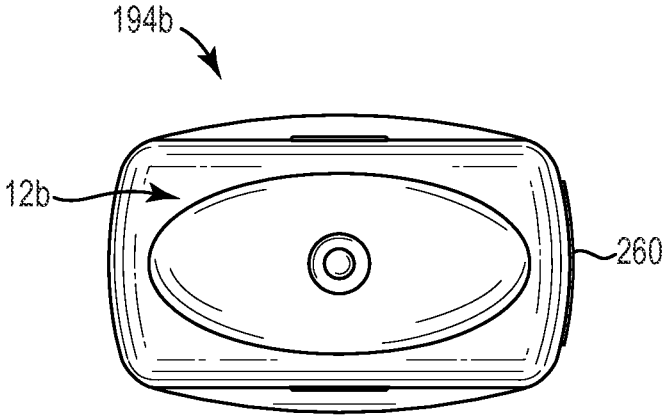
FIG. 53 is bottom view illustration of the second assembled container of FIG. 46, according to one embodiment of the invention.
Figure 54:
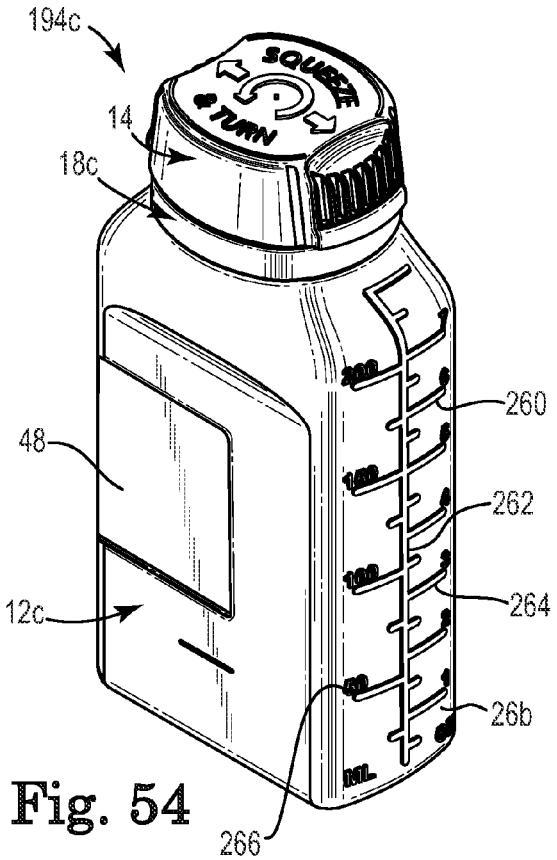
FIG. 54 is a front, top, and perspective view illustration of a third assembled container of the pharmacy system of FIG. 1, according to one embodiment of the invention.
Figure 55:
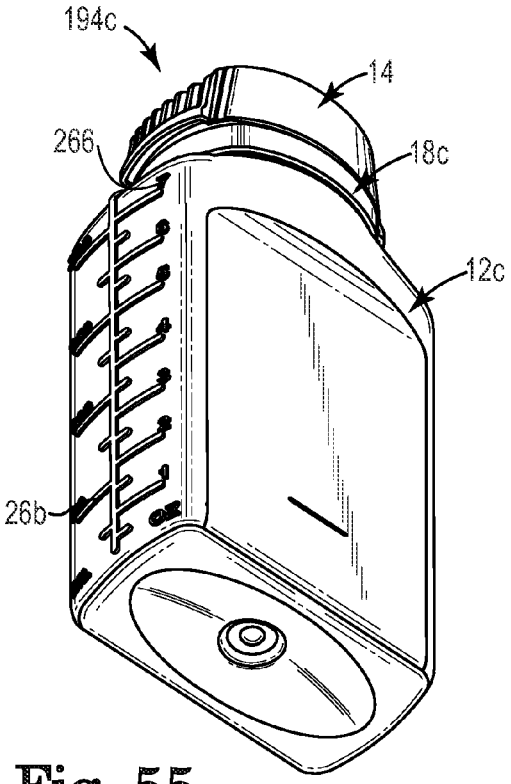
FIG. 55 is a rear, bottom, and perspective view illustration of the third assembled container of FIG. 54, according to one embodiment of the invention.
Figure 56:
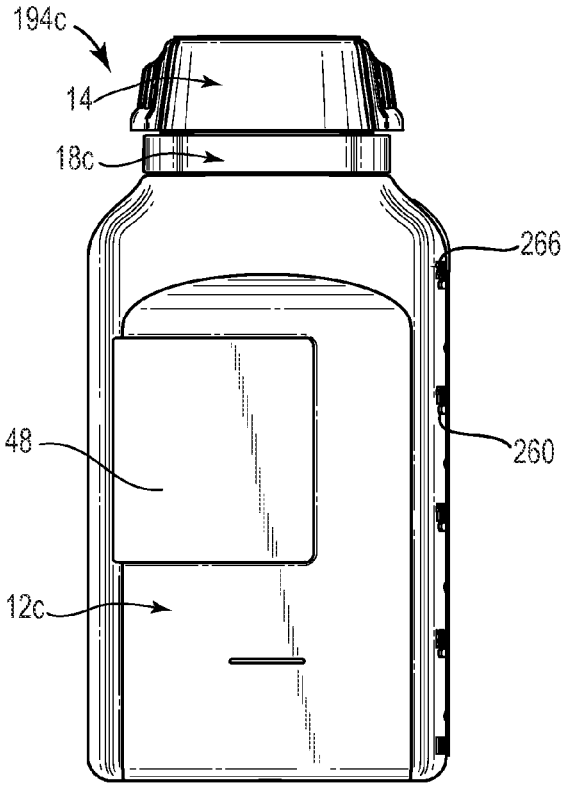
FIG. 56 is a front view illustration of the third assembled container of FIG. 54, according to one embodiment of the invention.
Figure 57:
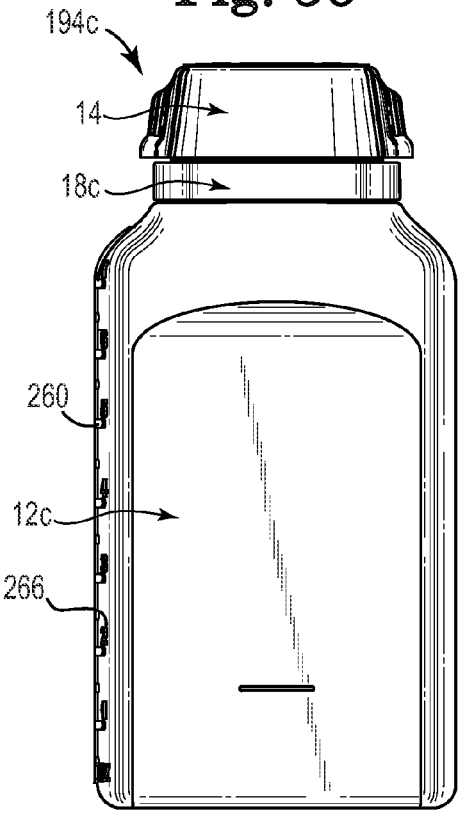
FIG. 57 is a rear view illustration of the third assembled container of FIG. 54, according to one embodiment of the invention.
Figure 58:
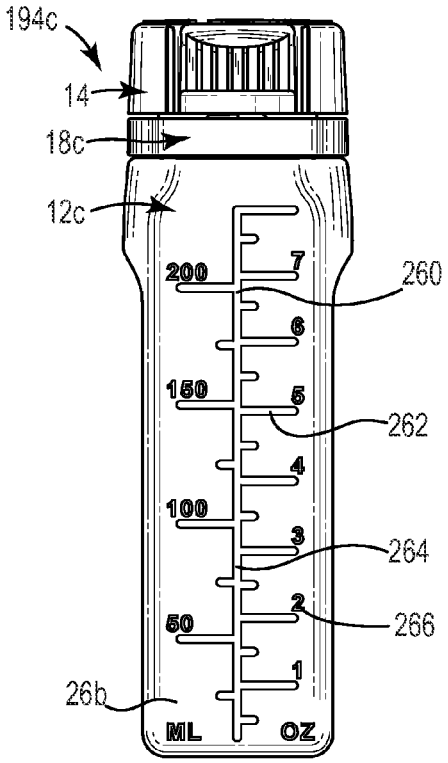
FIG. 58 is a right side view illustration of the third assembled container of FIG. 54, according to one embodiment of the invention.
Figure 59:
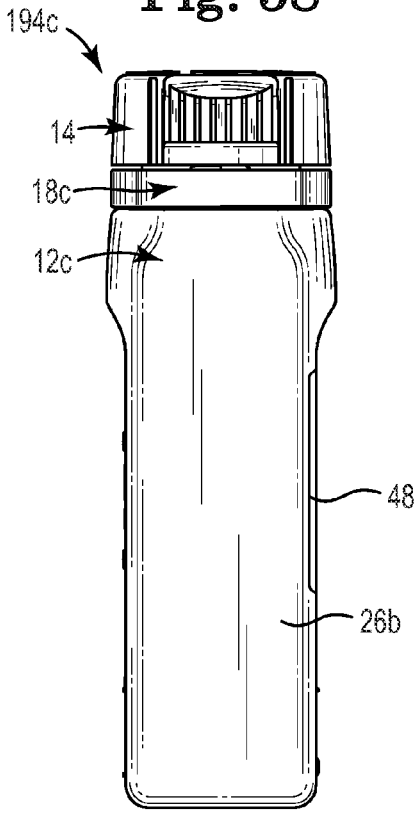
FIG. 59 is a left side view illustration of the third assembled container of FIG. 54, according to one embodiment of the invention.
Figure 60:
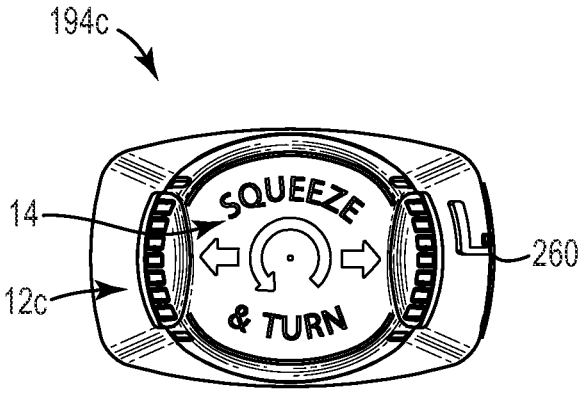
FIG. 60 is a top view illustration of the third assembled container of FIG. 54, according to one embodiment of the invention.
Figure 61:
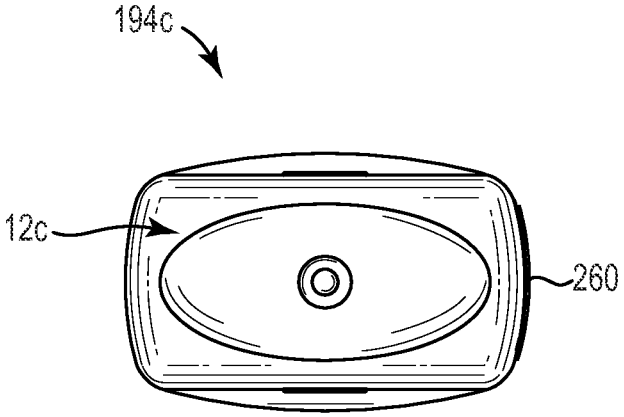
FIG. 61 is bottom view illustration of the third assembled container of FIG. 54, according to one embodiment of the invention.
Figure 62:
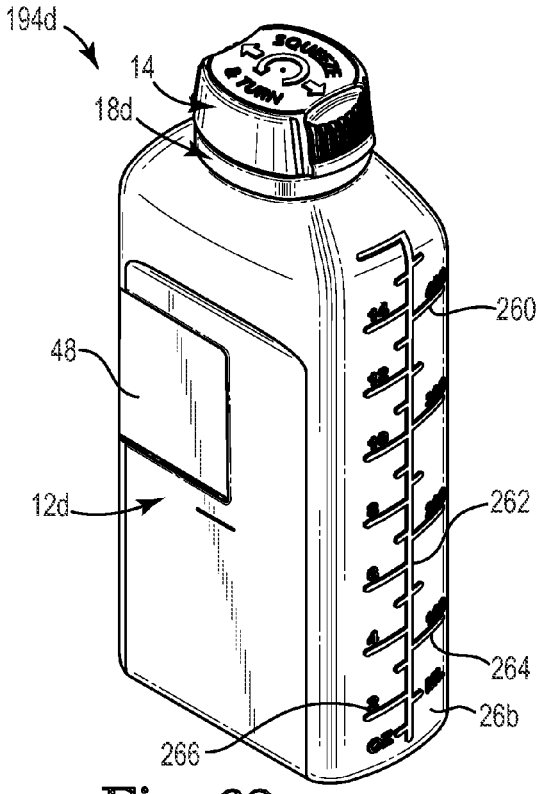
FIG. 62 is a front, top, and perspective view illustration of a fourth assembled container of the pharmacy system of FIG. 1, according to one embodiment of the invention.
Figure 63:
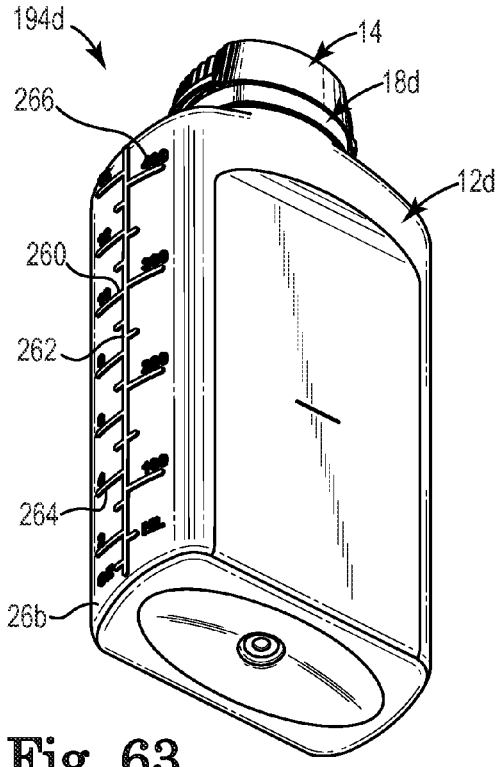
FIG. 63 is a rear, bottom, and perspective view illustration of the fourth assembled container of FIG. 62, according to one embodiment of the invention.
Figure 64:
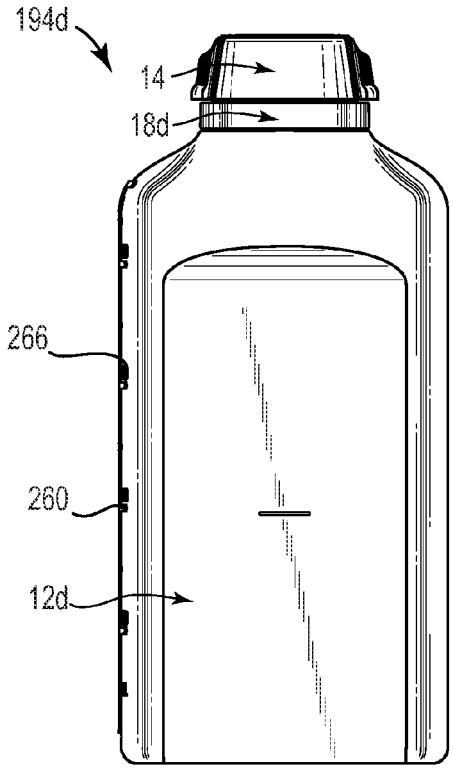
FIG. 64 is a front view illustration of the fourth assembled container of FIG. 62, according to one embodiment of the invention.
Figure 65:
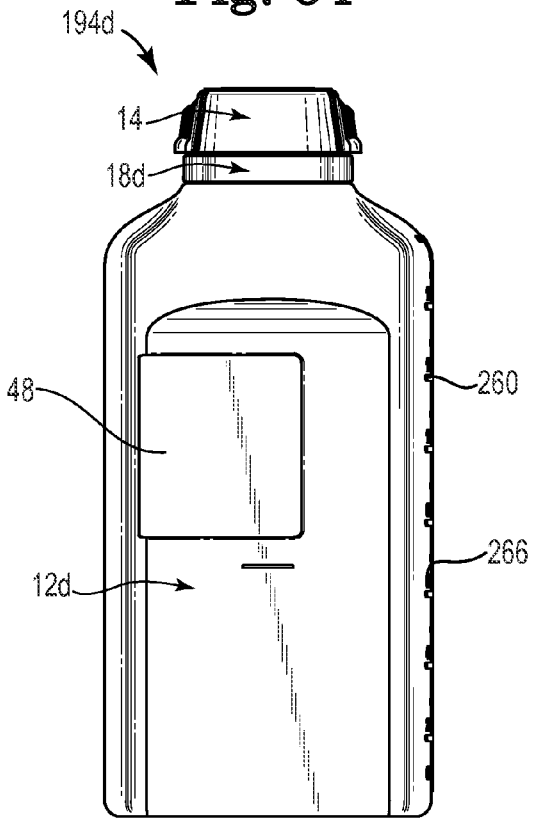
FIG. 65 is a rear view illustration of the fourth assembled container of FIG. 62, according to one embodiment of the invention.
Figure 66:
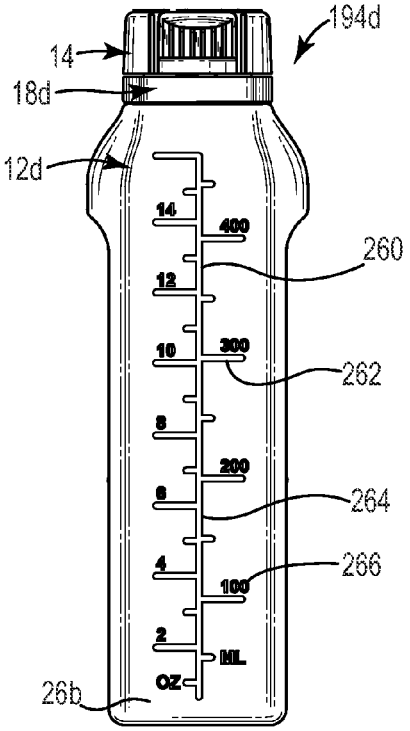
FIG. 66 is a right side view illustration of the fourth assembled container of FIG. 62, according to one embodiment of the invention.
Figure 67:
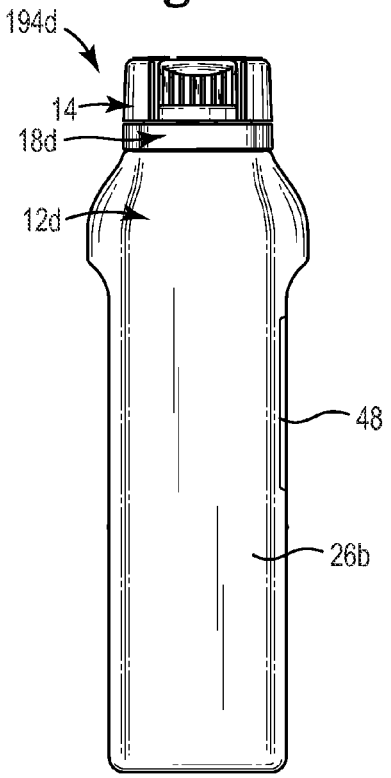
FIG. 67 is a left side view illustration of the fourth assembled container of FIG. 62, according to one embodiment of the invention.
Figure 68:
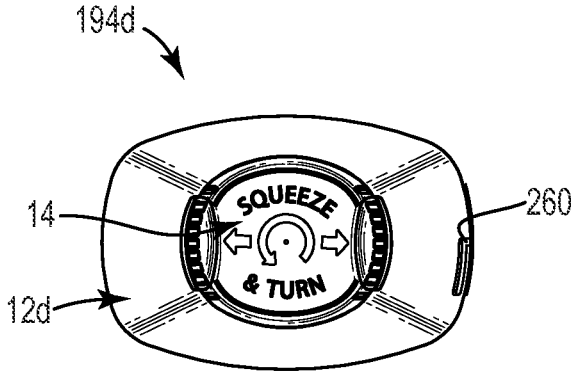
FIG. 68 is a top view illustration of the fourth assembled container of FIG. 62, according to one embodiment of the invention.
Figure 69:
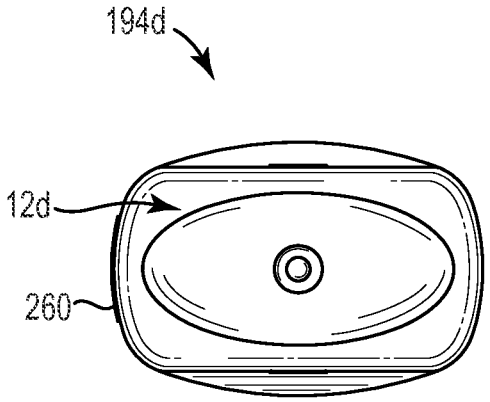
FIG. 69 is bottom view illustration of the fourth assembled container of FIG. 62, according to one embodiment of the invention.
Figure 70:
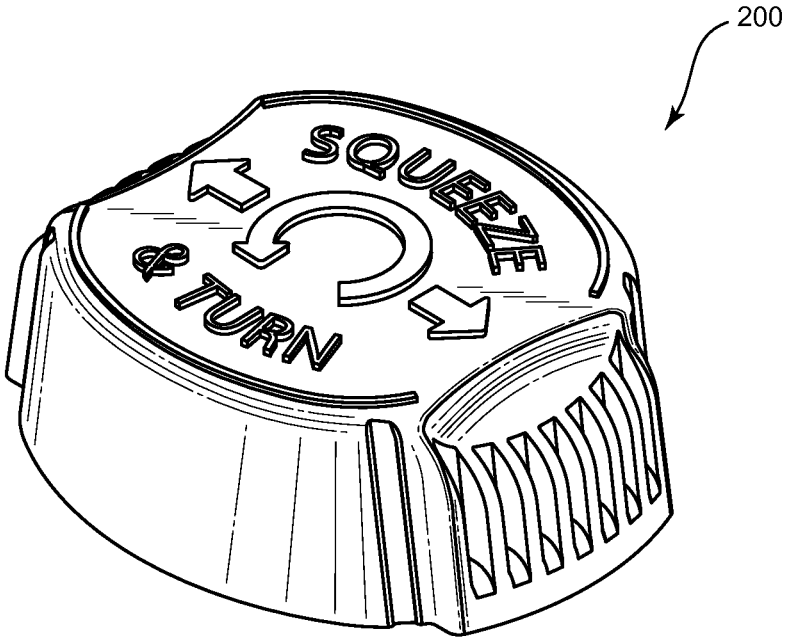
FIG. 70 is a front, top, and perspective view illustration of a child-resistant closure, according to one embodiment of the invention.
Figure 71:
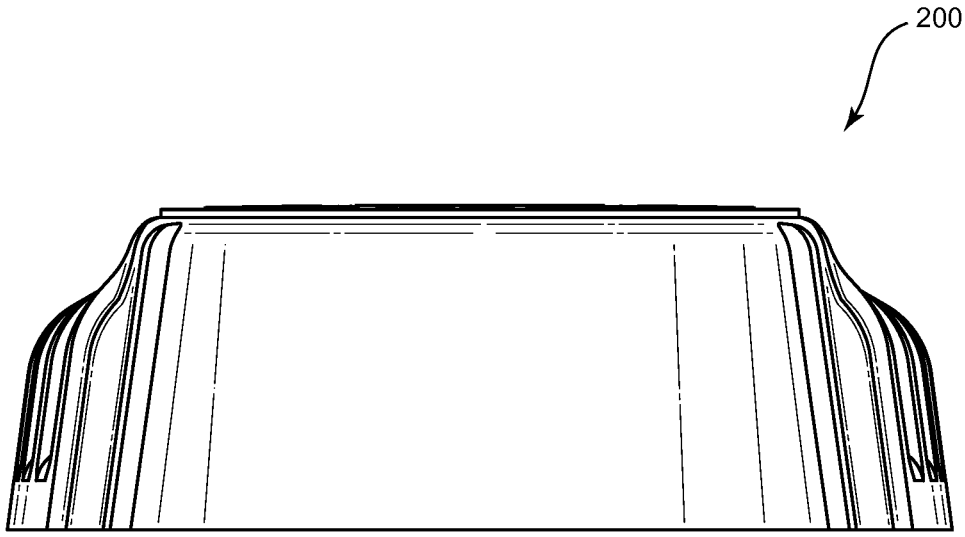
FIG. 71 is a front view illustration of the child-resistant closure of FIG. 70, according to one embodiment of the invention.
Figure 72:
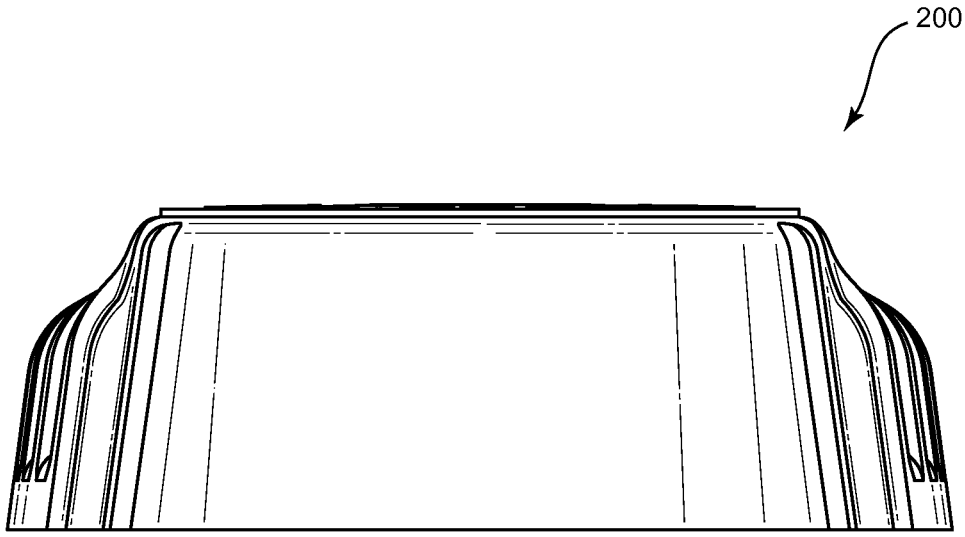
FIG. 72 is a rear view illustration of the child-resistant closure of FIG. 70, according to one embodiment of the invention.
Figure 73:
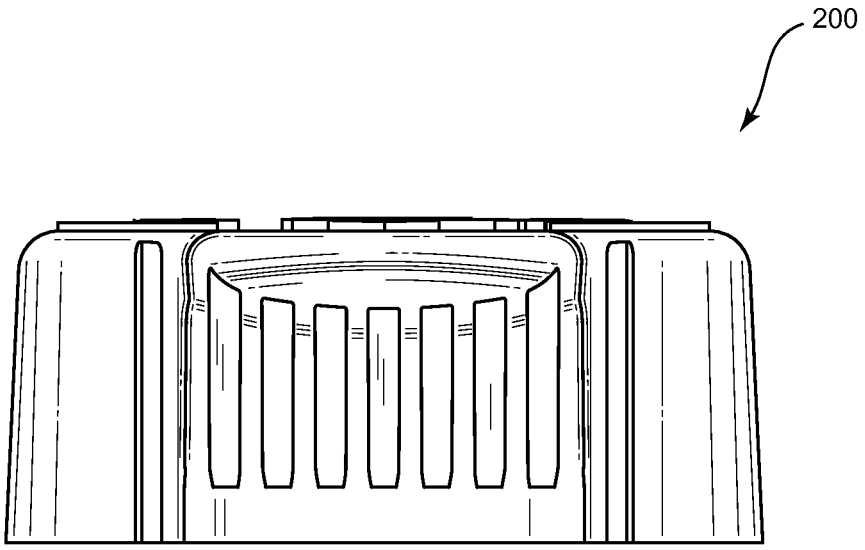
FIG. 73 is a right side view illustration of the child-resistant closure of FIG. 70, according to one embodiment of the invention.
Figure 74:
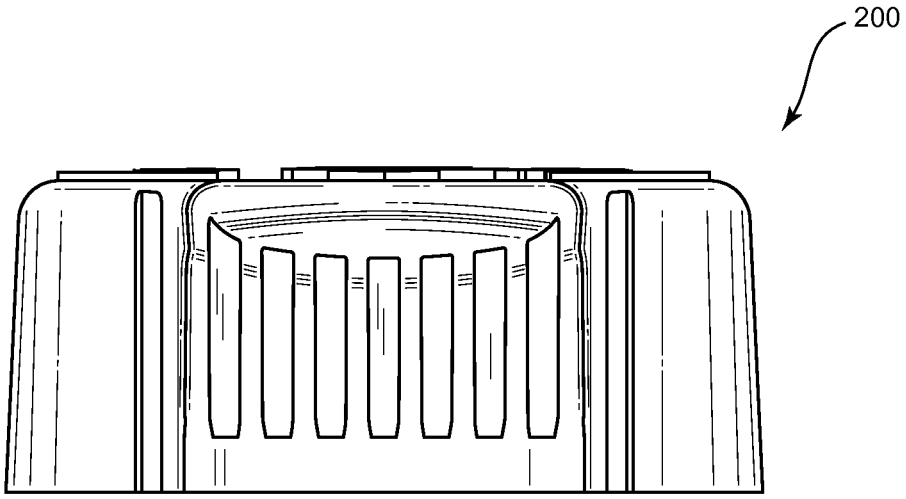
FIG. 74 is a left side view illustration of the child-resistant closure of FIG. 70, according to one embodiment of the invention.
Figure 75:
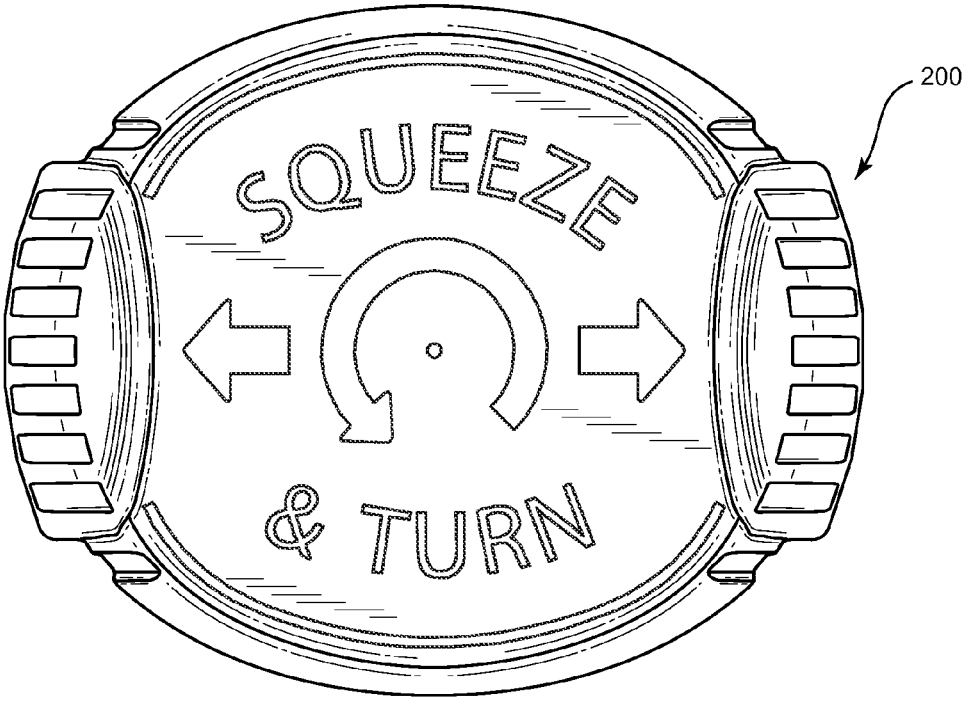
FIG. 75 is a top view illustration of the child-resistant closure of FIG. 70, according to one embodiment of the invention.
Figure 76:
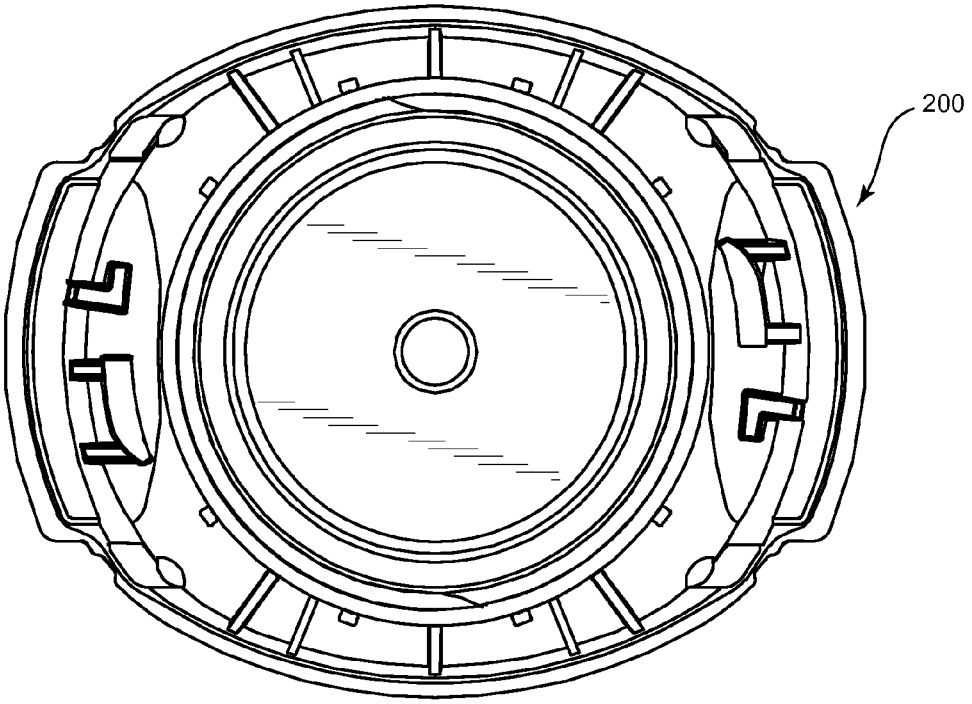
FIG. 76 is a bottom view illustration of the child-resistant closure of FIG. 70, according to one embodiment of the invention.

In one example, non child-resistant closure 16 additionally includes raised indicia 238 protruding slightly upwardly from exterior surface 216 of top panel 210 and providing instructions to a user for interacting with non child-resistant closure 16 and/or indicating that non child-resistant closure 16 is not child resistant. In one embodiment, non child-resistant closure 16 includes two diametrically opposed stops 240 similar to stops 180 of child-resistant closure 14 to prevent or at least decrease over-tightening or rotation of non child-resistant closure 16 relative to bottle 12*a*. Like stops 180, each stop 240 includes a radial portion 242 and a circumferential portion 244 forming each stop 240 as a substantially L-shaped stop. FIGS. 44 and 45 illustrate an assembled container 196 including bottle 12*a*, ring 18*a*, and non child-resistant closure 16.

FIG. 46-53 illustrate assembled container 196*b* including bottle 12*b*, ring 18*b*, which is substantially identical to ring 18*a* other than color and/or surface ornamentation, and child resistant closure 14. Bottle 12*b*, according to one embodiment, is larger than bottle 12*a*, for example is a 30 dram bottle, includes more rectangular side panel 28*b* than side panel 28 of bottle 12*a*. In one example, bottle 12*b* includes vertical and horizontal graduation lines 262 and 264 with associated graduated indicia 266 noting the volume measurements associated with bottle 12*b*. Assembled containers 196*c* and 196*d* with bottles 12*c* (e.g., a 60 dram bottle) and 12*d* (e.g., a 16 ounce bottle), respectively, are substantially similar to, but larger than bottle 12*b* and are illustrated in FIGS. 54-61 and 62-69, respectively. All bottles 12*a*, 12*b*, 12*c*, and 12*d* are substantially identical from planar shoulder surface 80, neck 22, and to top edge of neck 22 (as described above with respect to bottle 12*a*) such that all bottles 12*a*, 12*b*, 12*c*, and 12*d* use the same size of rings 18, child-resistant closure 14, and non child-resistant closure 16. In this manner, the overall inventory for pharmacy system (see FIG. 1) is greatly reduced in comparison to prior art systems.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A container comprising:

a bottle including:

a body defining a storage chamber therein, a neck extending away from the body and defining an opening opposite and providing access to the body, wherein the neck includes threads extending around an outside surface of the neck, and a pair of opposed ledges each extending radially outwardly from the neck and being spaced from each of and positioned between the body and the threads, wherein each of the pair of opposed ledges defines a surface facing away from the body toward the opening and includes a ramped extension extending from the surface further away from the body;

a closure secured over the opening and around the neck, wherein the closure is positioned on an opposite side of the surface of each of the pair of opposed ledges as compared to the body, and the closure includes internal ramps each interfacing with one of the ramped extensions to selectively maintain the closure in place over the opening; and a ring formed separately from the bottle and positioned between the body and the pair of opposed ledges, wherein the ring is entirely maintained below the surface of each of the pair of opposed ledges, and each of the pair of opposed ledges interacts with the ring to maintain the ring in place relative to the bottle.

2. The container of claim 1, wherein the closure defines a bottommost edge positioned entirely on the opposite side of the surface of each of the pair of opposed ledges as compared to the body.

3. The container of claim 1, wherein:

each ramped extension defines a ramped surface spaced from, facing, and tapered away from the neck, and the internal ramps of the closure each travel along a different one of the ramped surfaces as the closure is secured to the bottle.

4. The container of claim 1, wherein:

the closure includes an inner skirt for threadably interfacing with the neck, an outer skirt spaced from the inner skirt, and grip sections on each of opposing sides of the outer skirt, the grip sections are configured to flex under external forces as compared to a remainder of the outer skirt moving the internal ramps to a position allowing removal of the closure from around the neck.

5. The container of claim 1, wherein:

the bottle includes a rim circumferentially extending around and radially protruding from the neck, and the pair of opposed ledges extends from the rim.

6. The container of claim 5, wherein:

the bottle includes a stop extending from the rim toward the opening, and the stop is configured to interact with a closure received by the bottle and is positioned substantially mid-way between each of the pair of opposed ledges.

7. The container of claim 6, wherein the stop abuts the neck.

8. The container of claim 1, wherein each ramped extension is positioned on a leading half the corresponding one of the pair of opposed ledges and linearly angles inwardly toward the neck as the ramped extension extends toward a trailing edge of the corresponding one of the pair of opposed ledges.

9. The container of claim 1, wherein:

each of the pair of opposed ledges defines a free leading edge and a free trailing edge opposite the free leading edge, and each of the pair of opposed ledges tapers in thickness as it extends outwardly to each of the corresponding free leading edge and free trailing edge.

10. The container of claim 1, in combination with medicine maintained in the storage chamber.

11. The container of claim 1, wherein the ring includes an interior wall positioned adjacent the neck of the bottle and an exterior wall radially spaced from the interior wall such that a void is defined between the interior wall and the exterior wall of the ring.

12. The container of claim 1, in combination with a plurality of bottles of different storage volumes including the bottle, all of the plurality of bottles having a substantially identically sized neck and a substantially identically sized pair of opposed ledges, wherein the ring is one of a plurality of identically sized rings each configured to be secured to any one of the plurality of bottles.

13. The container of claim 1, in combination with medicine maintained in the storage chamber, wherein the ring has at least one of a color and an ornamentation previously assigned to a patient who was prescribed the medicine.

14. A container comprising:

a bottle including:

a body defining a storage chamber therein, a neck extending away from the body and defining an opening opposite and providing access to the body, wherein the neck includes threads extending around an outside surface of the neck, and a pair of opposed ledges each extending radially outwardly from the neck and being spaced from each of and positioned between the body and the threads, wherein each of the pair of opposed ledges defines a surface facing away from the body and includes a ramped extension extending from the surface further away from the body;

a closure secured over the opening and around the neck, wherein the closure is positioned on an opposite side of the surface of each of the pair of opposed ledges as compared to the body, and the closure includes internal ramps each interfacing with one of the ramped extensions to selectively maintain the closure in place over the opening; and a ring formed separately from the bottle and positioned between the body and the pair of opposed ledges, wherein the ring is entirely maintained below the surface of each of the pair of opposed ledges, and each of the pair of opposed ledges interacts with the ring to maintain the ring in place relative to the bottle;

wherein:

each of the pair of opposed ledges extends radially outwardly from the neck to a outermost surface, and the distance between the outermost surface of one of the pair of opposed ledges and the outermost surface of the other one of the pair of opposed ledges is equal to at least about 130% of an outer diameter of the neck.

15. A container comprising:

a bottle including:

a body defining a storage chamber therein, a neck extending away from the body and defining an opening opposite and providing access to the body, wherein the neck includes threads extending around an outside surface of the neck, and a pair of opposed ledges each extending radially outwardly from the neck and being spaced from each of and positioned between the body and the threads, wherein each of the pair of opposed ledges defines a surface facing away from the body and includes a ramped extension extending from the surface further away from the body;

a closure secured over the opening and around the neck, wherein the closure is positioned on an opposite side of the surface of each of the pair of opposed ledges as compared to the body, and the closure includes internal ramps each interfacing with one of the ramped extensions to selectively maintain the closure in place over the opening; and a ring formed separately from the bottle and positioned between the body and the pair of opposed ledges, wherein the ring is entirely maintained below the surface of each of the pair of opposed ledges, and each of the pair of opposed ledges interacts with the ring to maintain the ring in place relative to the bottle;

wherein:

the ring defines an interior wall, an exterior wall, and a pair of opposed indentations radially extending through the interior wall and toward the exterior wall, and the ring is positioned around the neck of the bottle with the pair of opposed indentations selectively engaging the pair of opposed ledges such that interaction between the pair of opposed indentations and the pair of opposed ledges maintains the ring in position relative to the bottle.

16. The container of claim 15, wherein:

the bottle includes a substantially planar shoulder surface adjacent the neck, the ring includes a first panel and a bottom edge of the ring opposite the first panel, the pair of opposed indentations includes a flange extending radially inwardly and vertically inset from each of the first panel and the bottom edge of the ring, the flanges of each of the pair of opposed indentations are configured to slide over a respective one of the pair of opposed ledges only when the ring is flexed, and the flanges of each of the pair of opposed indentations maintain the ring between the pair of opposed ledges and the substantially planar shoulder surface when the ring is not flexed.

17. The container of claim 16, wherein each of the pair of opposed indentations includes a plurality of tabs vertically extending on either side of the flange.

18. A method of preparing a prescription comprising:

providing a bottle including:

a body defining a storage chamber therein, a neck extending away from the body and defining an opening opposite and providing access to the body, wherein the neck includes threads extending around an outside surface of the neck, and a pair of opposed ledges each extending radially outwardly from the neck and being spaced from each of and positioned between the body and the threads, wherein each of the pair of opposed ledges defines a surface facing away from the body toward to opening, each of the pair of opposed ledges includes a ramped extension extending from the surface further away from the body;

securing a ring around the neck between the body and the pair of opposed ledges, wherein the ring is formed separately from the bottle, the ring is entirely maintained below the surface of each of the pair of opposed ledges, and once the ring is secured, each of the pair of opposed ledges interacts with the ring to maintain the ring in place relative to the bottle; and securing a closure around the neck of the bottle to cover the opening, wherein the closure is positioned on an opposite side of the surface of each of the pair of opposed ledges as compared to the body, and the closure includes internal ramps each interfacing with one of the ramped extensions to selectively maintain the closure in place over the opening.

19. The method of claim 18, further comprising dispensing medicine into the storage chamber.

20. The method of claim 18, wherein the closure defines a bottommost edge, and securing the closure around the neck results in the bottommost edge of the closure being positioned entirely on the opposite side of the surfaces of the pair of opposed ledges as compared to the body.

* * * * *